US011420448B2

(12) United States Patent
Yoshigi et al.

(10) Patent No.: US 11,420,448 B2
(45) Date of Patent: Aug. 23, 2022

(54) THERMAL HEAD CONTROL DEVICE, THERMAL PRINTER, AND THERMAL HEAD CONTROL METHOD

(71) Applicant: Seiko Instruments Inc., Chiba (JP)

(72) Inventors: Yuichi Yoshigi, Chiba (JP); Daisuke Yoshida, Chiba (JP); Yohei Ishidoya, Chiba (JP); Hiroaki Kondo, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 17/180,116

(22) Filed: Feb. 19, 2021

(65) Prior Publication Data

US 2021/0268807 A1 Sep. 2, 2021

(30) Foreign Application Priority Data

Feb. 28, 2020 (JP) ..... JP2020-032928

(51) Int. Cl.
*B41J 2/355* (2006.01)
*B41J 29/38* (2006.01)
(Continued)

(52) U.S. Cl.
CPC ..... *B41J 2/355* (2013.01); *B41J 2/32* (2013.01); *B41J 2/36* (2013.01); *B41J 29/38* (2013.01)

(58) Field of Classification Search
CPC ..... B41J 2/355; B41J 2/36; B41J 2/32; B41J 29/38
See application file for complete search history.

(56) References Cited

U.S. PATENT DOCUMENTS 5,412,406 A * 5/1995 Fujimoto ..... B41J 2/3551 347/180
10,137,714 B2 * 11/2018 Hata ..... B41J 2/04573
(Continued)

FOREIGN PATENT DOCUMENTS

JP H05-050638 A 3/1993
JP H08-258313 A 10/1996
(Continued)

OTHER PUBLICATIONS

Extended European Search Report in Europe Application No. 21159609.3, dated Jul. 13, 2021, 7 pages.

*Primary Examiner* — Yaovi M Ameh
(74) *Attorney, Agent, or Firm* — Crowell & Moring LLP

(57) ABSTRACT

A thermal head control device includes: a printing rate calculation range determination unit configured to determine, as a printing rate calculation range, a range from a left-end energization dot to a right-end energization dot among energization dots present in printing data corresponding to heating elements to be controlled among a plurality of heating elements included in a thermal head; a printing rate calculation unit configured to calculate a printing rate of the printing rate calculation range determined by the printing rate calculation range determination unit; an energizing time calculation unit configured to calculate an energizing time for which a current is caused to flow through the heating elements based on the printing rate calculated by the printing rate calculation unit; and an output unit configured to output a control signal for driving the heating elements to be controlled of the thermal head, based on the calculated energizing time.

8 Claims, 25 Drawing Sheets

(51) Int. Cl.
*B41J 2/36* (2006.01)
*B41J 2/32* (2006.01)

(56) References Cited

U.S. PATENT DOCUMENTS

2011/0069131 A1 3/2011 Tamura et al.
2018/0272747 A1* 9/2018 Ito ..... B41J 2/3555

FOREIGN PATENT DOCUMENTS

JP 2003-154696 A 5/2003
JP 2011-062941 A 3/2011

* cited by examiner

THERMAL HEAD CONTROL DEVICE, THERMAL PRINTER, AND THERMAL HEAD CONTROL METHOD

RELATED APPLICATIONS

This application claims priority to Japanese Patent Application No. 2020-032928, filed on Feb. 28, 2020, the entire content of which is incorporated herein by reference.

BACKGROUND OF THE INVENTION

1. Field of the Invention

The present invention relates to a thermal head control device, a thermal printer, and a thermal head control method.

2. Description of the Related Art

Hitherto, there has been known a technology in which, in a thermal printer configured to perform printing on a heat sensitive sheet by causing heating members arranged in one row to generate heat, a period of time for energizing the heating members is varied depending on the number of heating members to be simultaneously energized (printing rate).

In the technology described above, when the heating members to be energized are biased to be concentrated in a specific range within a range for which the printing rate is calculated, although the printing rate is high in the specific range, the calculated printing rate is low because the printing rate is calculated for the entire printable range. That is, in some cases, although the calculated printing rate is low, the printing rate is high in the specific range. That is, in a control method of the related art, the printing rate is calculated for the entire printable range even when the printing rate is high in the specific range, and hence there has been a problem in that an energizing time suitable for printing data cannot be calculated.

In view of the above, in this technical field, there have been demands for a thermal head control device, a thermal printer, and a thermal head control method with which an energizing time suitable for printing data can be calculated.

SUMMARY OF THE INVENTION

According to one embodiment of the present invention, there is provided a thermal head control device, including: a printing rate calculation range determination unit configured to determine, as a printing rate calculation range, a range from a left-end energization dot to a right-end energization dot among energization dots present in printing data corresponding to heating elements to be controlled among a plurality of heating elements included in a thermal head; a printing rate calculation unit configured to calculate a printing rate of the printing rate calculation range determined by the printing rate calculation range determination unit; an energizing time calculation unit configured to calculate an energizing time for which a current is caused to flow through the heating elements based on the printing rate calculated by the printing rate calculation unit; and an output unit configured to output a control signal for driving the heating elements to be controlled of the thermal head, based on the calculated energizing time.

In the above-mentioned thermal head control device according to the one embodiment of the present invention, wherein the energizing time in a case in which the printing rate calculated by the printing rate calculation unit is high is shorter than the energizing time in a case in which the printing rate calculated by the printing rate calculation unit is low.

In the above-mentioned thermal head control device according to the one embodiment of the present invention, wherein the printing rate calculation range determination unit is configured to set, as the heating elements to be controlled, the heating elements corresponding to one row and being included in the thermal head, to thereby determine the printing rate calculation range.

The above-mentioned thermal head control device according to the one embodiment of the present invention, further includes a division drive determination unit configured to determine whether to perform division drive of dividing the printing data into a plurality of pieces of printing data for energization when the printing data includes a predetermined number of energization dots or more, wherein the printing rate calculation unit is configured to set, when the division drive determination unit determines to perform the division drive, the heating elements present in a range of each of the plurality of divided pieces of printing data as the heating elements to be controlled, to thereby calculate the printing rate.

In the above-mentioned thermal head control device according to the one embodiment of the present invention, wherein the printing rate calculation unit is configured to calculate the printing rate by providing different weightings between a case in which adjacent heating elements are continuous energization dots and a case in which the adjacent heating elements are not continuous energization dots.

In the above-mentioned thermal head control device according to the one embodiment of the present invention, wherein the printing rate calculation range determination unit is configured to exclude, when a range including a predetermined number of continuous non-energization dots or more is present, the range from the printing rate calculation range.

According to one embodiment of the present invention, there is provided a thermal printer, including: a conveyance mechanism configured to convey a printing medium; a thermal head configured to perform printing on the printing medium; and the thermal head control device of any one of claims 1 to 6, which is configured to control the thermal head.

According to one embodiment of the present invention, there is provided a thermal head control method, including: calculating a printing rate of a predetermined printing rate calculation range in printing data to be transmitted to a thermal head including a plurality of heating elements arranged adjacent to each other; determining, as the predetermined printing rate calculation range, a range from a left-end energization dot to a right-end energization dot among energization dots present in the printing data; calculating an energizing time for which a current is caused to flow through the heating elements based on the printing rate calculated in the calculating a printing rate; and outputting a control signal for driving the thermal head based on the calculated energizing time.

DETAILED DESCRIPTION OF THE PREFERRED EMBODIMENTS

[Configuration of Thermal Printer]

Figure 1:
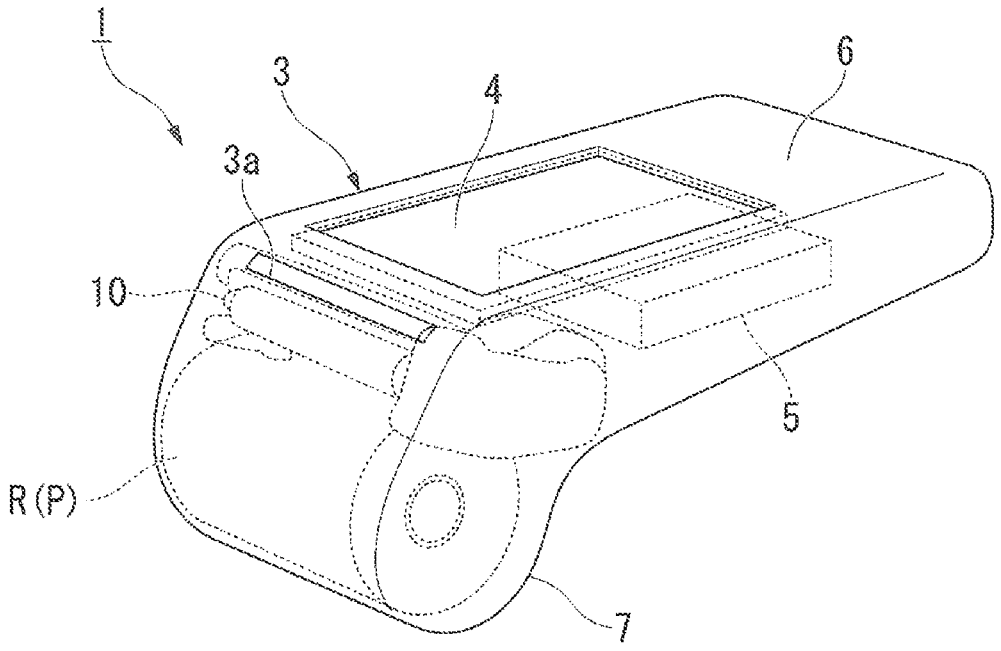
FIG. 1 is a perspective view for illustrating an example of a thermal printer according to at least one embodiment of the present invention.

FIG. 1 is a perspective view of a thermal printer 1. With reference to FIG. 1, a configuration of the thermal printer 1 is described. As illustrated in FIG. 1, the thermal printer 1 is capable of performing printing on a recording sheet P (printing medium). The recording sheet P is a heat sensitive sheet that develops a color when heat is applied thereto, and is used suitably for printing a variety of labels, receipts, and tickets. The recording sheet P is set in the thermal printer 1 in a state of a roll sheet R obtained by rolling the recording sheet P so as to have a hollow hole, and printing is performed on a part drawn from the roll sheet R.

The thermal printer 1 includes a casing 3, a display unit 4, a control unit 5, and a printing unit 10. The casing 3 formed into a hollow box-shape is made of a metal material or plastic such as ABS or a composite material of ABS and polycarbonate. The casing 3 includes a main body portion 6 having a rectangular parallelepiped shape, and a roll sheet receiving portion 7 formed at one end portion of the main body portion 6 in a longitudinal direction thereof so as to be bent toward one side of a thickness direction of the main body portion 6. The printing unit 10 is received at the one end portion of the main body portion 6 in the longitudinal direction. A discharge port 3*a* is formed in one end surface of the main body portion 6 in the longitudinal direction. The discharge port 3*a* is configured to discharge the recording sheet P printed by passing through the printing unit 10. The display unit 4 is arranged on a main surface of the main body portion 6, which faces the other side in the thickness direction. The display unit 4 is, for example, a liquid crystal panel. The display unit 4 is connected to the control unit 5, and is configured to display various kinds of information. The roll sheet receiving portion 7 is configured to receive the roll sheet R.

Figure 2:
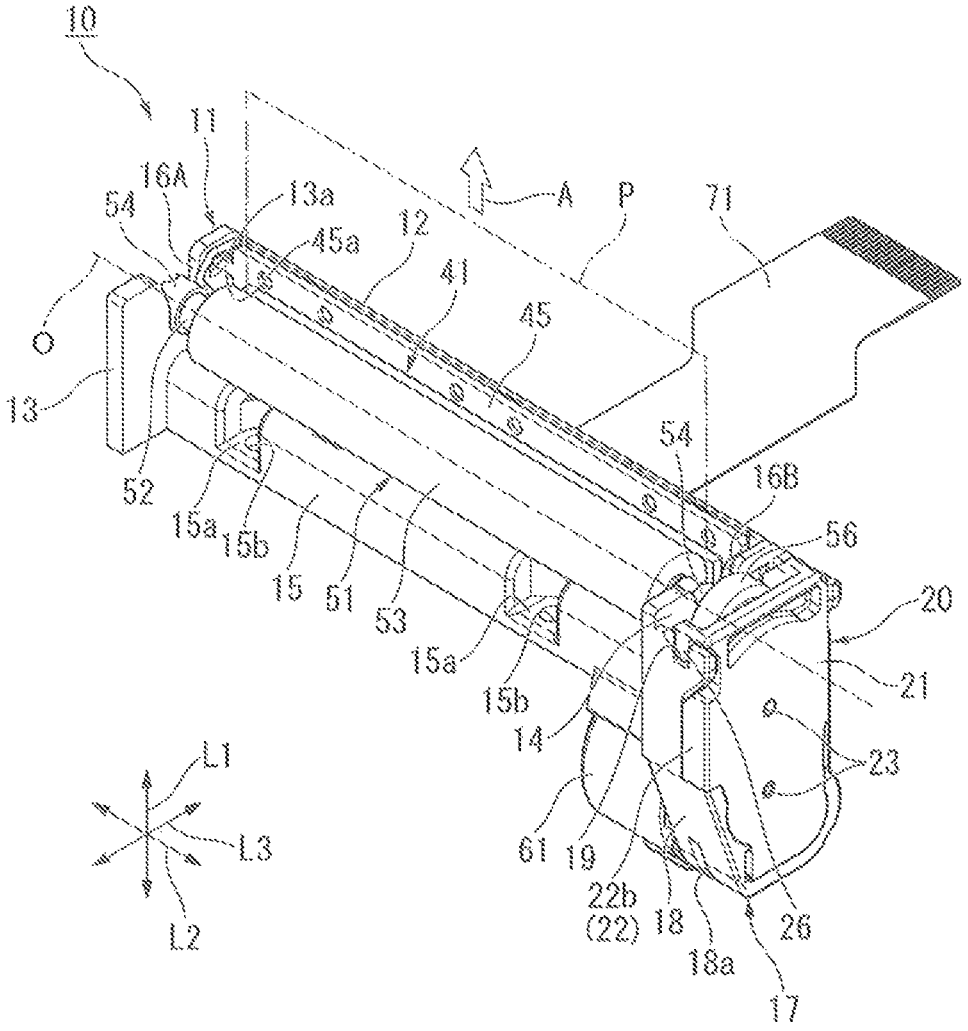
FIG. 2 is a perspective view for illustrating an example of a printing unit according to the at least one embodiment.

FIG. 2 is a perspective view of the printing unit 10. With reference to FIG. 2, the printing unit 10 is described. As illustrated in FIG. 2, the printing unit 10 is configured to discharge the recording sheet P passing between a platen roller 51 and a thermal head 41 in a direction indicated by an arrow A. Mainly in the description for the printing unit 10 below, a direction along the arrow A is defined as a vertical direction L1, and the direction indicated by the arrow A is defined as an upper side. Further, a direction along a rotation axis O of the platen roller 51 is defined as an axial direction L2. In addition, a direction orthogonal to the vertical direction L1 and the axial direction L2 is defined as a fore-and-aft direction L3, and the platen roller 51 side with respect to the thermal head 41 in the fore-and-aft direction L3 is defined as a front side.

A main body frame 11 is formed of, for example, a plate member such as a polycarbonate resin containing glass fibers. The main body frame 11 is formed into a U-shape opened toward the front side when viewed in the vertical direction L1. Specifically, the main body frame 11 includes a rear plate portion 12 extending in the axial direction L2, a first side wall portion 13 formed upright from one end portion of the rear plate portion 12 in the axial direction L2 toward the front side, a second side wall portion 14 formed upright from the other end portion of the rear plate portion 12 in the axial direction L2 toward the front side and a lower side, and a support portion 15 formed between the first side wall portion 13 and the second side wall portion 14.

The rear plate portion 12 is formed into a plate shape having a thickness in the fore-and-aft direction L3. The first side wall portion 13 is formed into a plate shape having a thickness in the axial direction L2. A first roller insertion groove 16A cut downward is formed in an upper end edge of the first side wall portion 13.

The second side wall portion 14 is formed into a plate shape having a thickness in the axial direction L2. The second side wall portion 14 extends from the other end portion of the rear plate portion 12 in the axial direction L2 toward the front side, and further extends therefrom toward the lower side. A second roller insertion groove 16B cut downward is formed in an upper end edge of the second side wall portion 14. The second roller insertion groove 16B is formed to match with the first roller insertion groove 16A in shape and formation position when viewed in the axial direction L2. The platen roller 51 is removably inserted into the first roller insertion groove 16A and the second roller insertion groove 16B (hereinafter referred to as "respective roller insertion grooves 16A and 16B").

A motor 61 is mounted on a part of the second side wall portion 14, which is located lower than a portion connecting the second side wall portion 14 and the rear plate portion 12. The motor 61 is mounted on an inner side of the second side wall portion 14, and an output shaft of the motor 61 passes through the second side wall portion 14 to protrude outward from the second side wall portion 14. The motor 61 is connected to the control unit 5 through intermediation of a flexible substrate 71 having a wiring pattern (not shown) printed and wired thereon. The motor 61 is configured to be driven based on a signal from the control unit 5.

A gearbox portion 17 is formed on the outer side of the second side wall portion 14. The gearbox portion 17 includes a peripheral wall portion 18 formed upright from a peripheral edge of the second side wall portion 14 toward the outer side. The peripheral wall portion 18 is formed into a U-shape opened toward the upper side when viewed in the axial direction L2. The gearbox portion 17 is opened toward the outer side.

Recessed portions 19 recessed downward are formed in an upper end edge of the peripheral wall portion 18 on the front side and an upper end edge thereof on a rear side, respectively. The pair of recessed portions 19 are formed to match with each other in shape and position when viewed in the fore-and-aft direction L3. Each of the recessed portions 19 is formed so that an opening thereof is enlarged toward the upper side when viewed in the fore-and-aft direction L3. Specifically, each of the recessed portions 19 includes, when viewed in the fore-and-aft direction L3, a bottom portion extending along the axial direction L2, an outer wall portion extending from an outer end portion of the bottom portion toward the upper side, an inner wall portion extending from an inner end portion of the bottom portion toward the upper side, and an inclined wall portion extending obliquely toward the upper side from an upper end edge of the inner wall portion toward one side in the axial direction L2. A height of the inner wall portion is approximately half a height of the outer wall portion. A position of an upper end edge of the inclined wall portion is substantially the same as that of an upper end edge of the outer wall portion in the vertical direction L1.

A first hole portion 18*a* and a second hole portion are formed in the peripheral wall portion 18. The first hole portion 18*a* is formed at a lower portion of a part of the peripheral wall portion 18, which faces the front side. The first hole portion 18*a* is formed into a rectangular shape elongated in the vertical direction L1 when viewed in the fore-and-aft direction L3. The second hole portion is formed at a lower portion of a part of the peripheral wall portion 18, which faces the rear side. The second hole portion is formed into a rectangular shape elongated in the vertical direction L1 when viewed in the fore-and-aft direction L3. The second hole portion is formed on the upper side with respect to the first hole portion 18*a* in the vertical direction L1.

Reduction gears (not shown) are assembled to the gearbox portion 17.

The support portion 15 is formed into a columnar shape extending along the axial direction L2. One end portion of the support portion 15 in the axial direction L2 is connected to an inner surface of the first side wall portion 13, and the other end portion of the support portion 15 in the axial direction L2 is connected to an inner surface of the second side wall portion 14. A pair of mounting portions 15*a* recessed downward when viewed in the fore-and-aft direction L3 are formed in the support portion 15. The pair of mounting portions 15*a* are formed with an interval secured therebetween in the axial direction L2. A through hole 15*b* passing through a bottom portion of each of the mounting portions 15*a* in the vertical direction is formed in the bottom portion of each of the mounting portions 15*a*. The main body frame 11 is mounted to the casing 3 by inserting fastening members such as bolts into the through holes 15*b* of the support portion 15.

The thermal head 41 is configured to perform printing on the recording sheet P. The thermal head 41 is formed into a rectangular shape having its longitudinal direction defined as the axial direction L2 when viewed in the fore-and-aft direction L3. The thermal head 41 is arranged under a state in which the longitudinal direction of the thermal head 41 matches with the width direction of the recording sheet P. On a head surface of the thermal head 41, a large number of heating elements 42 are arrayed in the axial direction L2. The head surface of the thermal head 41 is opposed to a printing surface of the recording sheet P, and the recording sheet P may be nipped between the head surface and an outer peripheral surface of the platen roller 51. The thermal head 41 includes a plurality of heating elements 42 arranged to be adjacent to each other. The thermal head 41 is connected to the control unit 5 through intermediation of the flexible substrate 71. A driver IC (not shown) mounted on the thermal head 41 is configured to control heat generation of the heating elements 42 based on the signal from the control unit 5. Through the control of the heat generation of the heating elements 42, the thermal head 41 prints, for example, various kinds of letters and figures on the printing surface of the recording sheet P.

The thermal head 41 is bonded and fixed onto a head support member 45 supported on the main body frame 11. The head support member 45 is a plate-like member having its longitudinal direction defined as the axial direction L2, and the thermal head 41 is bonded and fixed onto a front surface of the head support member 45. The head support member 45 is arranged between the first side wall portion 13 and the second side wall portion 14 and between the rear plate portion 12 and the support portion 15.

Elastic members (not shown) configured to bias the head support member 45 and the rear plate portion 12 in directions away from each other are interposed between the head support member 45 and the rear plate portion 12. That is, the elastic members are configured to press the head support member 45 constantly toward the front side. The plurality of elastic members are arrayed in the axial direction L2 with intervals secured therebetween.

A pair of stoppers 45*a* configured to regulate a pivot range of the head support member 45 are formed at upper end portions of the head support member 45. Each stopper 45*a* extends outward in the axial direction L2 of the head support member 45, and is formed so as to face each of an inside of a hole portion 13*a* formed in an upper part of the first side wall portion 13 of the main body frame 11 and an inside of a hole portion 14*a* formed in an upper part of the second side wall portion 14. The stoppers 45*a* are movable inside the hole portions 13*a* and 14*a*, respectively, along with the pivot of the head support member 45, and may be brought into contact with end surfaces of the hole portions 13*a* and 14*a*, respectively. Through the contact of the stoppers 45*a* with the end surfaces of the hole portions 13*a* and 14*a*, the pivot amount of the head support member 45 is regulated.

The platen roller 51 is arranged so as to be opposed to the thermal head 41, and is rotated about the rotation axis O under a state in which the recording sheet P is nipped between the platen roller 51 and the thermal head 41, to thereby convey the recording sheet P in the direction indicated by the arrow A. The platen roller 51 includes a roller shaft 52, a roller main body 53 mounted on the roller shaft 52, and a pair of bearings 54 mounted at both ends of the roller shaft 52. The roller shaft 52 is formed slightly longer than the separation distance between the first side wall portion 13 and the second side wall portion 14 of the main body frame 11. The roller main body 53 is made of, for example, rubber, and is arranged along the axial direction L2 uniformly over the entire region excluding portions corresponding to both the ends of the roller shaft 52.

The pair of bearings 54 of the platen roller 51, which are mounted on both ends thereof, are inserted into the roller insertion grooves 16A and 16B of the main body frame 11, respectively. With this, the platen roller 51 is held so as to be rotatable about the rotation axis O relative to the main body frame 11 and removable from the main body frame 11. The platen roller 51 is arranged so that the roller main body 53 is brought into contact with the thermal head 41 under the state in which the platen roller 51 is inserted into the roller insertion grooves 16A and 16B and the recording sheet P drawn out from the roll sheet R is nipped between the platen roller 51 and the thermal head 41.

A driven gear 56 is fixed on the other end portion of the platen roller 51 in the axial direction L2. The driven gear 56 is assembled to an upper part of the gearbox portion 17 when the platen roller 51 is held on the first side wall portion 13 and the second side wall portion 14. The platen roller 51 is rotated under a state of being held on the first side wall portion 13 and the second side wall portion 14, thereby being capable of conveying the recording sheet P.

A gear cover 20 configured to close the entire opening of the gearbox portion 17 when viewed in the axial direction L2 is mounted on the opening of the gearbox portion 17. It is preferred that the gear cover 20 be formed of a material having higher toughness than that of the main body frame 11, and for example, the gear cover 20 is formed of an ABS resin.

Figure 3:
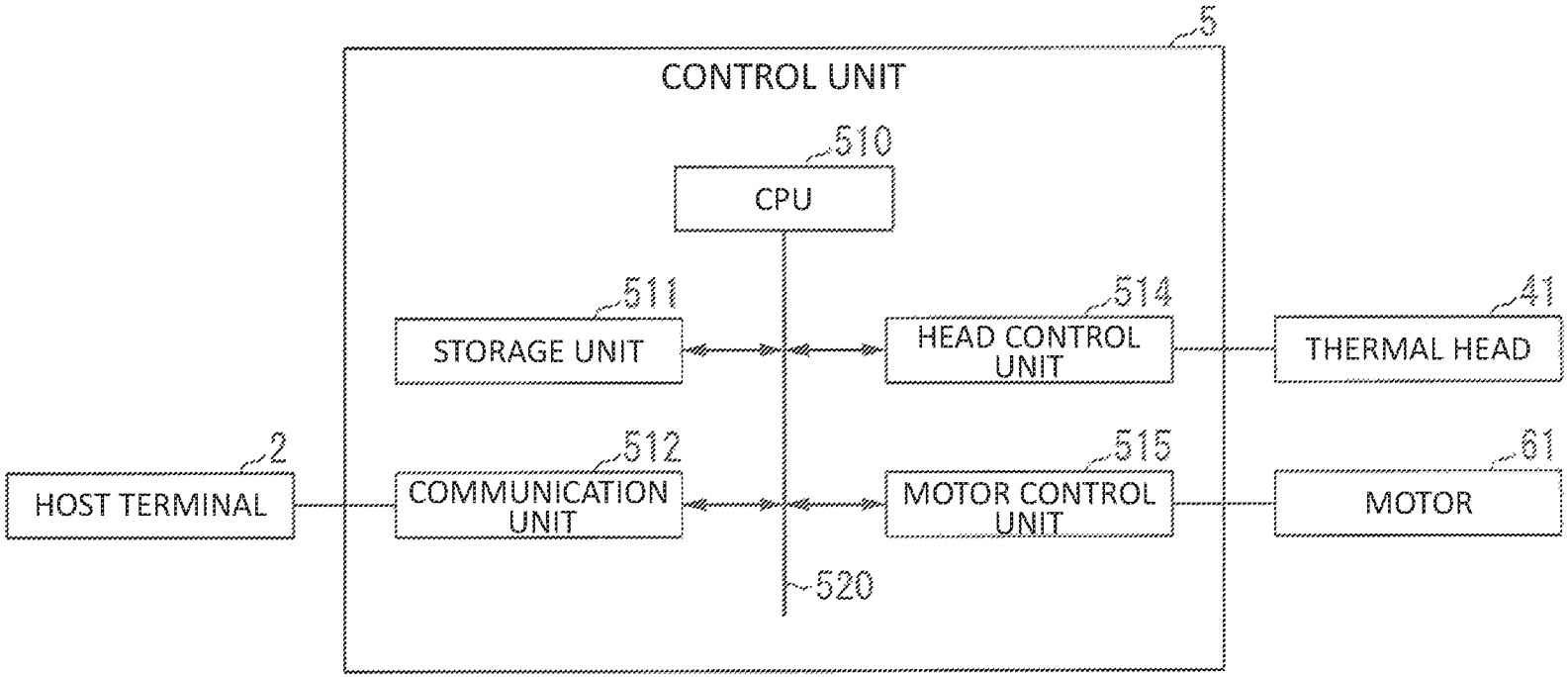
FIG. 3 is a diagram for illustrating an example of a functional configuration of a control unit in the at least one embodiment.

FIG. 3 is a diagram for illustrating an example of a functional configuration of the control unit 5 in the at least one embodiment of the present invention. The control unit 5 includes a CPU 510, a storage unit 511, a communication unit 512, a head control unit (thermal head control device) 514, and a motor control unit 515. The units are connected to one another via a bus 520.

The CPU 510 includes a central processing unit (CPU), and is configured to control each unit of the thermal printer 1. The head control unit 514 is controlled by the CPU 510 to control the drive of the thermal head 41 configured to perform printing on the sheet P. The motor control unit 515 is controlled by the CPU 510 to drive the motor 61 to rotate the platen roller 51, to thereby convey the sheet P at predetermined pitches (for example, for each dot line). The motor 61 and the platen roller 51 are also referred to as "conveyance mechanism."

The storage unit 511 includes, as a storage medium, for example, a read-only memory (ROM) or a random-access memory (RAM). The storage unit 511 may also include a hard disk drive (HDD), a flash memory, or the like. The storage unit 511 is configured to store, for example, a program to be executed by the CPU 510, and data required when the CPU 510 executes that program. The storage unit 511 is also configured to store detection results obtained by a variety of sensors (not shown) included in the thermal printer 1 and others.

The communication unit 512 is connected to a host terminal 2 for communication. The communication unit 512 is configured to receive data input from the host terminal 2, and output a control command and various kinds of data included in the data input to the CPU 510.

First Embodiment

Figure 4:
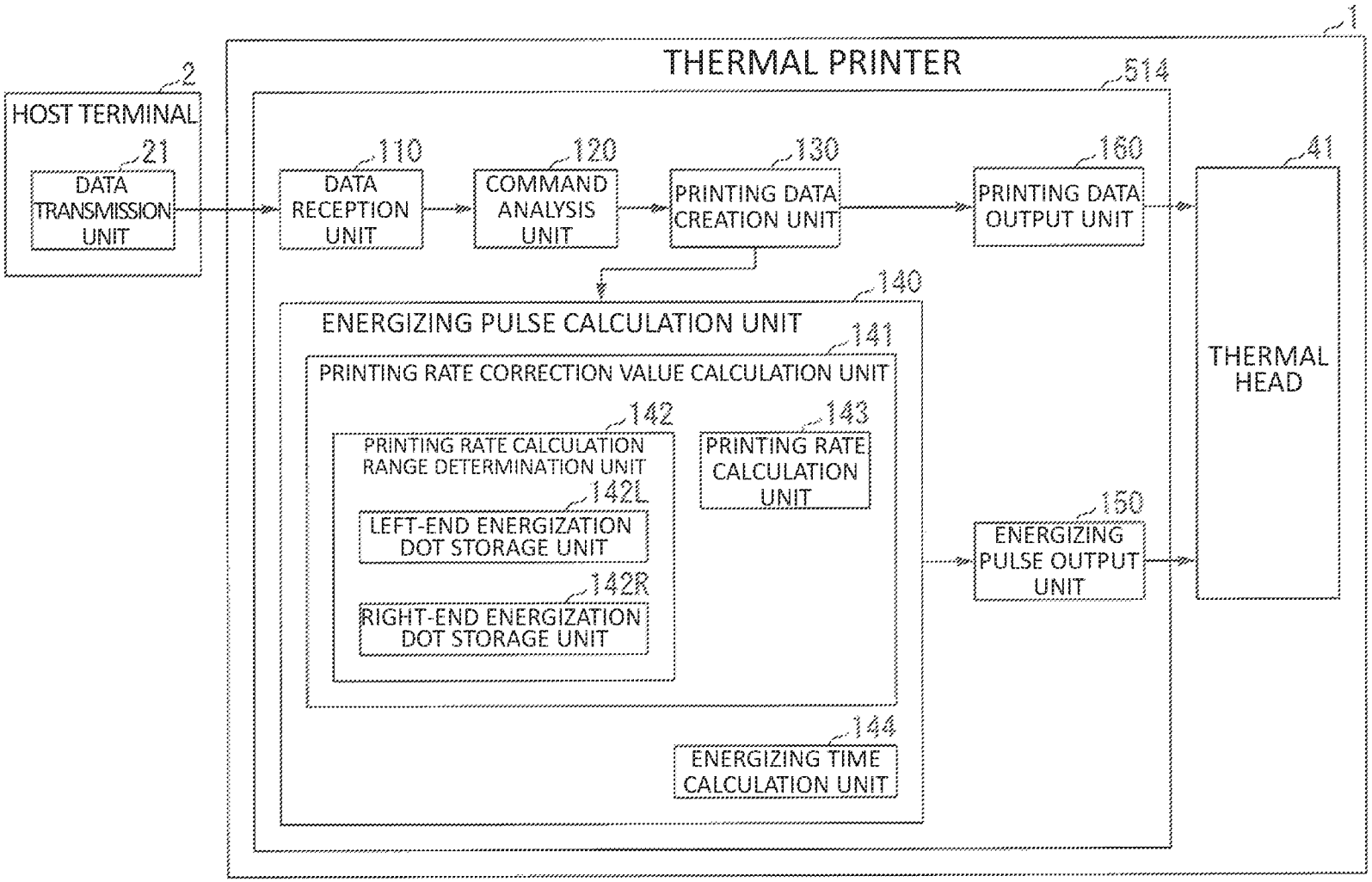
FIG. 4 is a diagram for illustrating an example of a functional configuration of a head control unit in a first embodiment of the present invention.

With reference to FIG. 4 to FIG. 8, an example of the thermal printer 1 according to a first embodiment of the present invention is described. FIG. 4 is a diagram for illustrating an example of a functional configuration of the head control unit 514 in the first embodiment. With reference to FIG. 4, the functional configuration of the head control unit 514 is described. As illustrated in FIG. 4, the head control unit 514 includes a data reception unit 110, a command analysis unit 120, a printing data creation unit 130, an energizing pulse calculation unit 140, an energizing pulse output unit (output unit) 150, and a printing data output unit 160.

The host terminal 2 is an electronic device such as a personal computer, a tablet terminal, a smartphone, or other mobile terminals. The host terminal 2 includes a data transmission unit 21, and is configured to transmit printing data or the like to the thermal printer 1.

The data reception unit 110 is configured to receive data input transmitted from the host terminal 2. The data reception unit 110 is configured to provide the received data input to the command analysis unit 120. Examples of the data input to be received by the data reception unit 110 include printing data for use in printing by the thermal head 41, and setting change commands for changing the settings of the thermal printer 1.

The command analysis unit 120 is configured to acquire the data input from the data reception unit 110. The command analysis unit 120 is configured to analyze the command of the acquired data input. When the acquired information is the printing data, the command analysis unit 120 provides the acquired information to the printing data creation unit 130.

The printing data creation unit 130 is configured to acquire the printing data from the command analysis unit 120. The printing data creation unit 130 is configured to extract data to be output to the thermal head 41 out of the information included in the acquired printing data, to thereby create transfer printing data. The transfer printing data is information to be transferred to the thermal head 41, and contains information indicating whether each of the heating elements 42 included in the thermal head 41 is an energization dot or a non-energization dot. The printing data creation unit 130 is configured to provide the created transfer printing data to the energizing pulse calculation unit 140 and the printing data output unit 160.

The printing data output unit 160 is configured to output the acquired transfer printing data to the thermal head 41. The printing data output unit 160 is configured to output the transfer printing data through, for example, clock-synchronous serial communication.

The energizing pulse calculation unit 140 is configured to calculate an energizing time for each dot line in the transfer printing data created by the printing data creation unit 130. The energizing pulse calculation unit 140 includes a printing rate correction value calculation unit 141 and an energizing time calculation unit 144. The printing rate correction value calculation unit 141 includes a printing rate calculation range determination unit 142 and a printing rate calculation unit 143.

Figure 5:
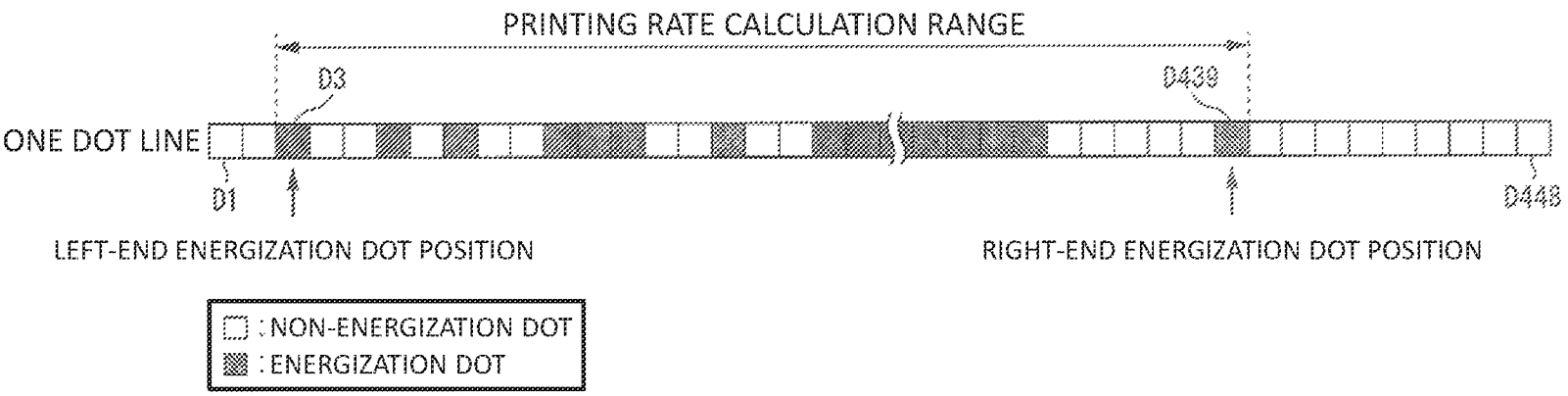
FIG. 5 is a view for illustrating a printing rate calculation range determining method in the first embodiment.

FIG. 5 is a view for illustrating a printing rate calculation range determining method in the first embodiment. With reference to FIG. 5, the determining method to be performed by the printing rate calculation range determination unit 142 is described. "ONE DOT LINE" includes the plurality of heating elements 42 included in the thermal head 41. For example, description is given of a case in which the thermal head 41 includes 448 dots of heating elements 42. In FIG. 5, the heating element 42 arranged at the left end of the thermal head 41 is referred to as "dot D1," and the heating element 42 arranged at the right end thereof is referred to as "dot D448." The heating elements 42 are arrayed in order from the left-end dot D1 to the right-end dot D448. In this example, the heating elements 42 from the left-end dot D1 to the right-end dot D448 are heating elements 42 to be controlled. Dots represented by outline squares are non-energization dots, and dots represented by solid squares are energization dots.

In the example illustrated in FIG. 5, the left-end dot D1 and the dot D2 adjacent to the dot D1 are non-energization dots. The dot D3 adjacent to the dot D2 is an energization dot. In this example, the energization dot positioned at the left end is the dot D3, and hence the dot D3 is a left-end energization dot. Further, in the example illustrated in FIG. 5, the right-end dot D448 is a non-energization dot. There are nine continuous non-energization dots to the left from the dot D448, and the dot D439 is an energization dot. In this example, the energization dot positioned at the right end is the dot D439, and hence the dot D439 is a right-end energization dot. The printing rate calculation range determination unit 142 is configured to determine a range from the dot D3 to the dot D439 as a printing rate calculation range. That is, the printing rate calculation range determination unit 142 is configured to determine a range from the left-end energization dot to the right-end energization dot among the energization dots present in the printing data as the printing rate calculation range. The printing rate calculation range determination unit 142 is configured to determine the printing rate calculation range for each dot line (printing data corresponding to one row).

Referring back to FIG. 4, the printing rate calculation range determination unit 142 includes a left-end energization dot storage unit 142L and a right-end energization dot storage unit 142R. The left-end energization dot storage unit 142L is configured to store the position of the left-end energization dot. In the example of FIG. 5, the left-end energization dot storage unit 142L stores the dot D3 as the left-end energization dot. The right-end energization dot storage unit 142R is configured to store the position of the right-end energization dot. In the example of FIG. 5, the right-end energization dot storage unit 142R stores the dot D439 as the right-end energization dot.

The printing rate calculation unit 143 is configured to calculate the printing rate of the predetermined printing rate calculation range in the printing data to be transmitted to the thermal head 41. Specifically, the printing rate calculation unit 143 is configured to calculate the printing rate in the calculation range determined by the printing rate calculation range determination unit 142. The printing rate calculation unit 143 is configured to calculate the printing rate for each dot line (printing data corresponding to one row).

The energizing time calculation unit 144 is configured to calculate an energizing time for which a current is caused to flow through the heating elements 42 based on the printing rate calculated by the printing rate calculation unit 143. In this example, when the printing rate calculated by the printing rate calculation unit 143 is high, the energizing time calculation unit 144 decreases the energizing time, and when the printing rate calculated by the printing rate calculation unit 143 is low, the energizing time calculation unit 144 increases the energizing time.

The energizing time calculation unit 144 may be configured to calculate the energizing time based on, in place of the printing rate calculated by the printing rate calculation unit 143, a power supply voltage of the thermal printer 1 (for example, a battery voltage), an ambient temperature of the thermal printer 1, or a combined resistance value of the plurality of heating elements 42 included in the thermal head 41. The combined resistance value of the heating elements 42 may be, for example, a predetermined value or a value measured when the power is turned on. The energizing pulse calculation unit 140 is configured to provide the information indicating the energizing time calculated by the energizing time calculation unit 144 to the energizing pulse output unit 150.

The energizing pulse output unit 150 is configured to output a control signal for driving the thermal head 41 based on the calculated energizing time. Specifically, the energizing pulse output unit 150 is configured to acquire the information indicating the energizing time from the energizing pulse calculation unit 140, and output an energizing pulse that is based on the energizing time indicated by the acquired information to the thermal head 41.

Figure 6:
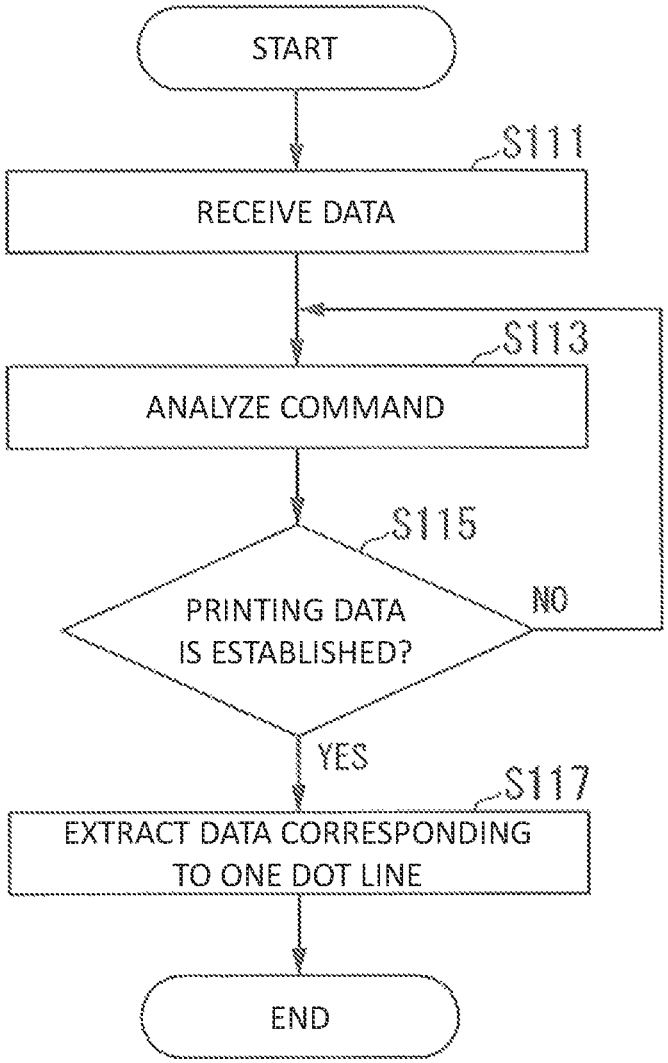
FIG. 6 is a flowchart for illustrating a flow of processing of data extraction for one dot line in the first embodiment.

FIG. 6 is a flowchart for illustrating a flow of processing of data extraction for one dot line in the first embodiment. With reference to FIG. 6, the flow of the processing of data extraction for one dot line is described.

(Step S111) The data reception unit 110 receives the data input transmitted from the host terminal 2. The data reception unit 110 provides the received data input to the command analysis unit 120.

(Step S113) The command analysis unit 120 acquires the data input from the data reception unit 110. The command analysis unit 120 analyzes the command of the acquired data input. When the acquired information is the printing data, the command analysis unit 120 provides the acquired information to the printing data creation unit 130.

(Step S115) The printing data creation unit 130 acquires the printing data from the command analysis unit 120. The printing data creation unit 130 creates the transfer printing data. When the transfer printing data is established (Step S115: YES), the printing data creation unit 130 advances the processing to Step S117. When the transfer printing data is not established (Step S115: NO), the printing data creation unit 130 returns the processing to Step S113. The case in which the transfer printing data is not established refers to, for example, a case in which the printing data is unauthorized data.

(Step S117) The printing data creation unit 130 extracts data corresponding to one dot line. The printing data creation unit 130 provides the extracted data corresponding to one dot line to the energizing pulse calculation unit 140 to end the processing.

Figure 7:
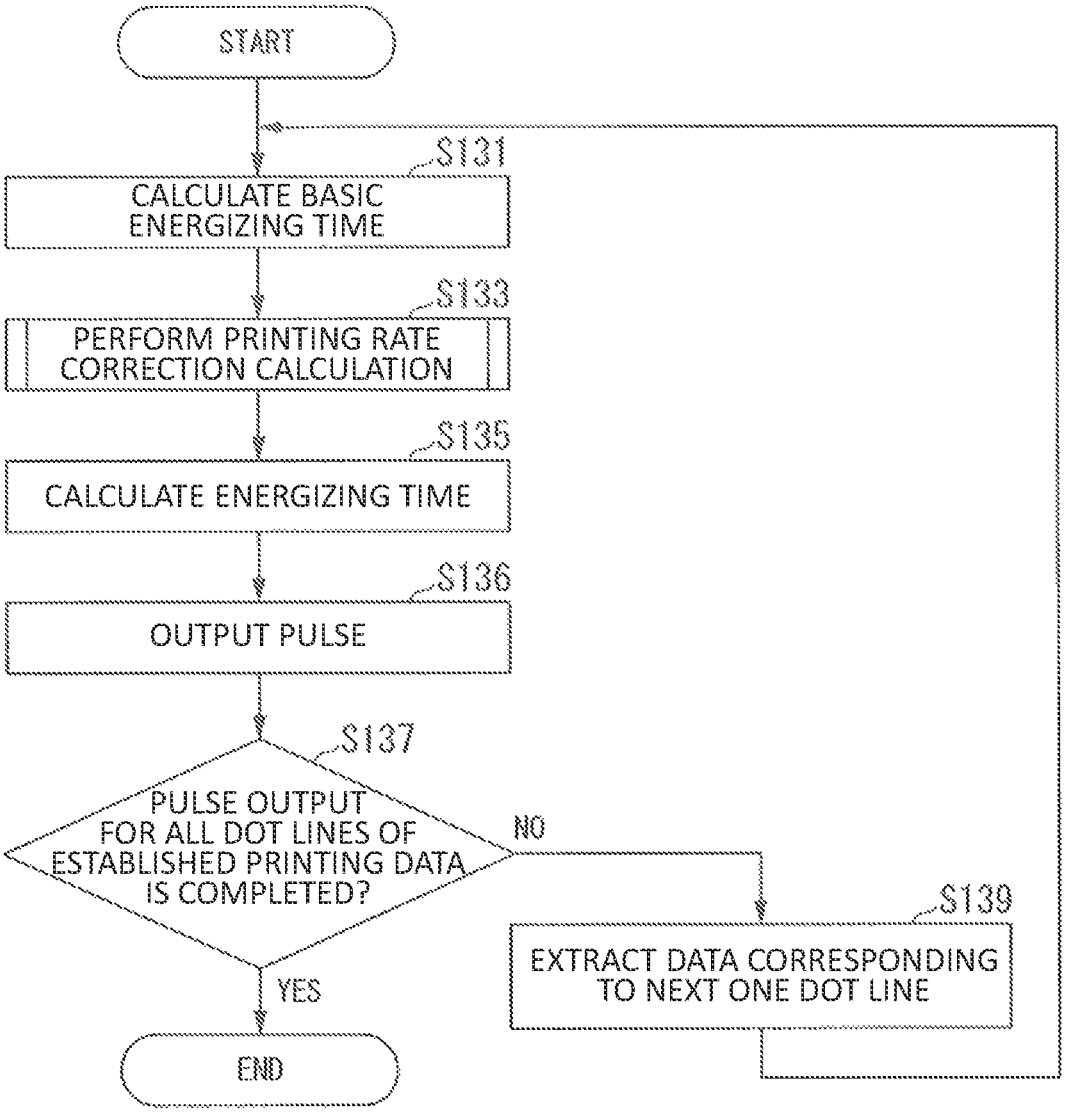
FIG. 7 is a flowchart for illustrating a flow of pulse output processing in the first embodiment.

FIG. 7 is a flowchart for illustrating a flow of pulse output processing in the first embodiment. With reference to FIG. 7, the flow of the pulse output processing is described. The pulse output processing to be described with reference to FIG. 7 is processing to be performed after the processing of data extraction for one dot line described with reference to FIG. 6.

(Step S131) The energizing pulse calculation unit 140 calculates a basic energizing time. The basic energizing time refers to an energizing time independent of the printing rate. The basic energizing time refers to, for example, an energizing time calculated based on the power supply voltage of the thermal printer 1, the ambient temperature of the thermal printer 1, or the combined resistance value of the heating elements 42.

Figure 8:
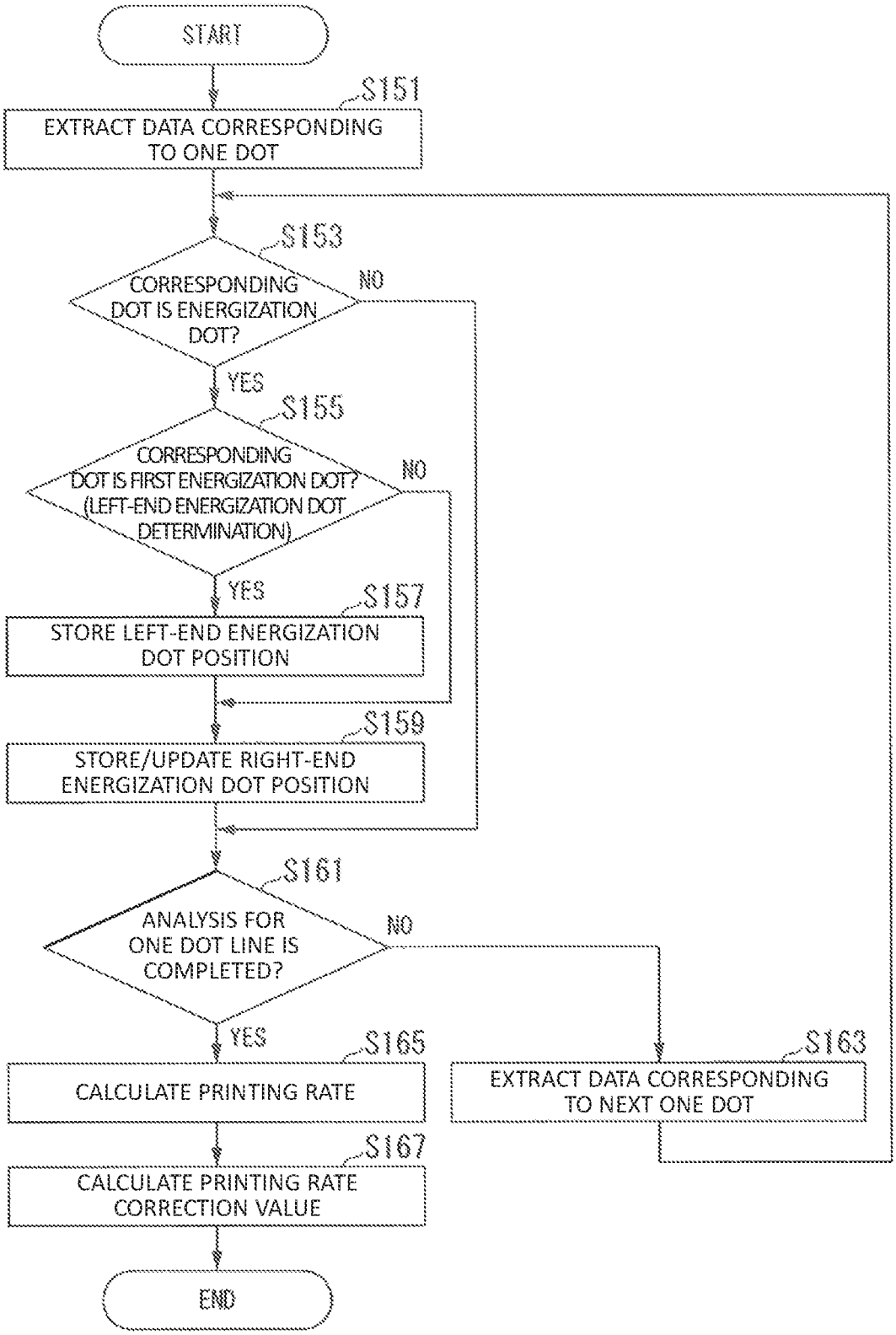
FIG. 8 is a flowchart for illustrating a flow of printing rate correction calculation processing in the first embodiment.

(Step S133) The printing rate correction value calculation unit 141 performs printing rate correction calculation for each dot line. With reference to FIG. 8, a flow of printing rate correction calculation processing is described.

FIG. 8 is a flowchart for illustrating the flow of the printing rate correction calculation processing in the first embodiment.

(Step S151) The printing rate correction value calculation unit 141 extracts data corresponding to one dot from the data corresponding to one dot line. For example, the printing rate correction value calculation unit 141 extracts the left-end dot (dot D1 illustrated in FIG. 5).

(Step S153) The printing rate correction value calculation unit 141 determines whether or not the corresponding dot is an energization dot. When the corresponding dot is an energization dot (Step S153: YES), the printing rate correction value calculation unit 141 advances the processing to Step S155. When the corresponding dot is a non-energization dot (Step S153: NO), the printing rate correction value calculation unit 141 advances the processing to Step S161.

(Step S155) The printing rate correction value calculation unit 141 determines whether or not the corresponding dot being the energization dot is a first energization dot. For example, when a value stored in the left-end energization dot storage unit 142L is reset, the printing rate correction value calculation unit 141 determines that the corresponding dot being the energization dot is the first energization dot. When the corresponding dot is the first energization dot (Step S155; YES), the printing rate correction value calculation unit 141 advances the processing to Step S157. When the corresponding dot is not the first energization dot (Step S155: NO), the printing rate correction value calculation unit 141 advances the processing to Step S159.

(Step S157) The printing rate correction value calculation unit 141 causes the left-end energization dot storage unit 142L to store the position of the corresponding dot being the energization dot.

(Step S159) The printing rate correction value calculation unit 141 causes the right-end energization dot storage unit 142R to store the position of the corresponding dot being the energization dot. When a value is already stored in the right-end energization dot storage unit 142R, the printing rate correction value calculation unit 141 updates the stored value.

(Step S161) The energizing pulse calculation unit 140 determines whether or not the analysis for one dot line is completed. When the analysis for one dot line is completed (Step S161: YES), the energizing pulse calculation unit 140 advances the processing to Step S165. When the analysis for one dot line is not completed (Step S161: NO), the energizing pulse calculation unit 140 advances the processing to Step S163.

(Step S163) The energizing pulse calculation unit 140 extracts data corresponding to the next one dot. For example, the energizing pulse calculation unit 140 extracts data of the adjacent dot.

(Step S165) The printing rate calculation range determination unit 142 sets the position information of the dots stored in the left-end energization dot storage unit 142L and the right-end energization dot storage unit 142R as the printing rate calculation range, to thereby calculate the printing rate calculation range.

(Step S167) The printing rate calculation range determination unit 142 calculates a printing rate correction value based on the calculated printing rate calculation range.

Referring back to FIG. 7, the energizing pulse calculation unit 140 calculates the energizing time based on the calculated printing rate. With reference back to FIG. 7, the pulse output processing is described.

(Step S135) The energizing time calculation unit 144 calculates the energizing time for each dot line based on the printing rate correction calculation performed by the printing rate correction value calculation unit 141.

(Step S136) The energizing pulse output unit 150 outputs an energizing pulse corresponding to the energizing time calculated by the energizing time calculation unit 144 to the thermal head 41.

(Step S137) When the pulse output for all dot lines of the established printing data is completed (Step S137: YES), the energizing pulse calculation unit 140 ends the processing. When the pulse output for all dot lines of the established printing data is not completed (Step S137: NO), the energizing pulse calculation unit 140 advances the processing to Step S139.

(Step S139) The printing data creation unit 130 extracts data corresponding to the next one dot line. The printing data creation unit 130 provides the extracted data corresponding to the next one dot line to the energizing pulse calculation unit 140, and advances the processing to Step S131.

According to the first embodiment described above, the head control unit 514 includes the printing rate calculation range determination unit 142 to determine the printing rate calculation range for each dot line. The printing rate calculation unit 143 calculates the printing rate in the printing rate calculation range determined by the printing rate calculation range determination unit 142. The energizing time calculation unit 144 calculates the energizing time that is based on the calculated printing rate. Thus, according to the first embodiment, the energizing time that is based on the printing rate in a range of one dot line in which the energization dots are present can be calculated. That is, the energizing time suitable for the printing data can be calculated. Further, according to the first embodiment, the energizing time suitable for the printing data can be calculated, and hence the heating elements 42 can be supplied with energy suitable for the printing data.

In this case, hitherto, there has been a problem in that, in a combination of a thermal head having a large bias in heat generation temperature distribution in the heating element 42 and a recording sheet P having a bad color developing property (for example, a heat sensitive sheet having a narrow range in which an optical density (OD value) exceeds 1), the color changes within one dot to cause a bad printing quality. In such a case, in the combination of the thermal head having a large bias in heat generation temperature distribution in the heating element 42 and the recording sheet P having a bad color developing property, when a black solid pattern is printed with the energy matching with a character printing quality, blank dots may be caused to decrease the OD value. Meanwhile, when the energy matching with the black solid pattern is used, blank dots in the black solid pattern may be solved, but the character is blurred because the energy is insufficient for the character. That is, when the energy is set so as to match with a pattern having a low printing rate, for example, a character, the energy becomes excessive for a non-character having a high printing rate, and hence blank dots are caused in the non-character having a high printing rate. When the energy is set so as to match with the non-character having a high printing rate, the energy becomes insufficient for a pattern having a low printing rate, for example, a character, and hence the printing is blurred.

According to at least one embodiment of the present invention, the energy is calculated in consideration of heat transferred from the adjacent heating element 42, thereby being capable of supplying the sheet with more appropriate energy as compared to that in control of the related art. Therefore, the excess or shortage of the energy is reduced, and the printing quality is improved.

Further, according to at least one embodiment of the present invention, the energizing time in a case in which the printing rate calculated by the printing rate calculation unit 143 is high is shorter than that in a case in which the printing rate calculated by the printing rate calculation unit 143 is low. That is, when the printing rate is high, the energizing time calculation unit 144 decreases the energizing time. Therefore, application of excessive energy is suppressed, thereby being capable of suppressing occurrence of blank dots and reducing power consumption.

Further, according to at least one embodiment of the present invention, the energizing pulse calculation unit 140 calculates the energizing pulse for each dot line. That is, according to at least one embodiment of the present invention, the printing rate calculation range for which the printing rate is calculated is different for each dot line. Therefore, according to at least one embodiment of the present invention, appropriate energy can be calculated for each dot line.

Second Embodiment

Figure 9:
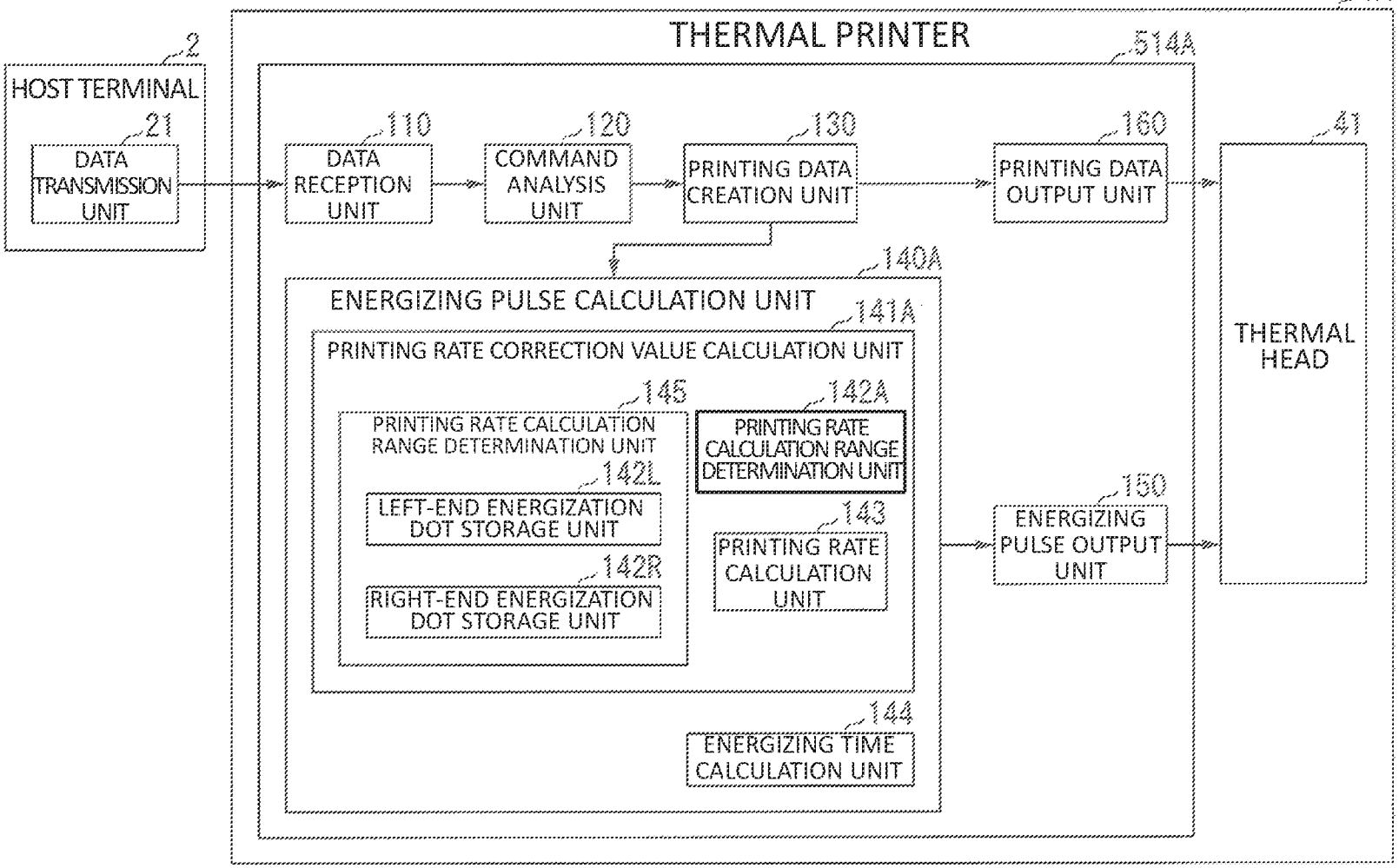
FIG. 9 is a diagram for illustrating an example of a functional configuration of a head control unit in a second embodiment of the present invention.

With reference to FIG. 9 to FIG. 14, an example of a thermal printer 1A according to a second embodiment of the present invention is described. FIG. 9 is a diagram for illustrating an example of a functional configuration of a head control unit 514A in the second embodiment. The head control unit 514A is different from the head control unit 514 in including an energizing pulse calculation unit 140A in place of the energizing pulse calculation unit 140. Like configurations as those described with reference to FIG. 4 are denoted by like reference symbols, and description thereof may be omitted. The energizing pulse calculation unit 140A includes a printing rate correction value calculation unit 141A and the energizing time calculation unit 144. The printing rate correction value calculation unit 141A is a modification example of the printing rate correction value calculation unit 141. The printing rate correction value calculation unit 141A includes a division drive determination unit 145, a printing rate calculation range determination unit 142A, and the printing rate calculation unit 143.

The division drive determination unit 145 is configured to perform control of whether or not to perform division drive for each dot line. In this case, the division drive is a thermal head driving method of dividing the printing data into a plurality of pieces of printing data for energization when the printing data corresponding to one dot line includes a predetermined number of energization dots or more. That is, the division drive determination unit 145 is configured to determine whether or not to perform division drive of dividing the printing data into a plurality of pieces of printing data for energization when the printing data includes a predetermined number of energization dots or more.

In the second embodiment, the left-end energization dot storage unit 142L and the right-end energization dot storage unit 142R are included in the division drive determination unit 145. The division drive determination unit 145 is configured to cause the left-end energization dot storage unit 142L to store the left-end energization dot and cause the right-end energization dot storage unit 142R to store the right-end energization dot when the division drive is determined to be performed. The printing rate calculation range determination unit 142A is configured to determine the printing rate calculation range based on the left-end energization dot stored in the left-end energization dot storage unit 142L and the right-end energization dot stored in the right-end energization dot storage unit 142R.

In one dot line to be subjected to division drive, the printing rate calculation range is determined for each divided division range. That is, one dot line to be subjected to division drive includes the left-end energization dot and the right-end energization dot for each division range. With reference to FIG. 10 to FIG. 13, the division drive is described.

Figure 10:
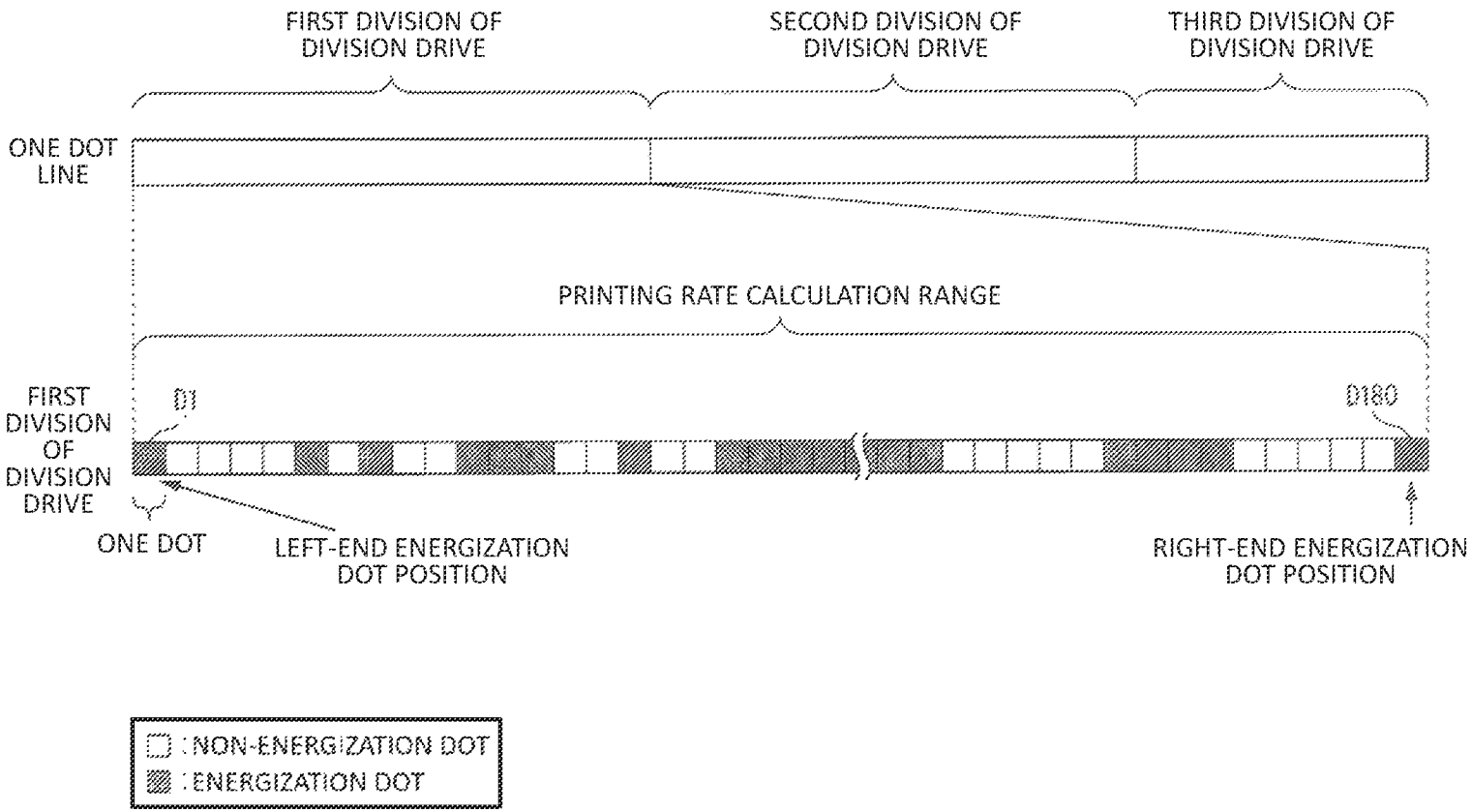
FIG. 10 is a view for illustrating a first division of division drive in the second embodiment.

FIG. 10 is a view for illustrating a first division of the division drive in the second embodiment. For example, when the thermal head 41 includes 448 dots of heating elements 42, one dot line includes 448 dots of from the dot D1 to the dot D448. In this example, description is given of an example of a case in which the maximum number of simultaneously energized dots is 100 dots. In FIG. 10, "ONE DOT LINE" represents the entire thermal head. That is, "ONE DOT LINE" represents dots of from the dot D1 to the dot D448. In "ONE DOT LINE", the left end is the dot D1, and the right end is the dot D448. The one dot line illustrated in FIG. 10 is divided into three division ranges of from a division range 1 to a division range 3. "FIRST DIVISION OF DIVISION DRIVE" represents details of the dots in the division range 1.

When the maximum number of simultaneously energized dots is 100 dots, the division range 1 includes 100 energization dots. In this example, the left-end energization dot is the dot D1, and the right-end energization dot is the dot D180. Accordingly, the printing rate calculation range is a range from the dot D1 to the dot D180. Therefore, the printing rate of the division range 1 is 55.5 percent (%).

Figure 11:
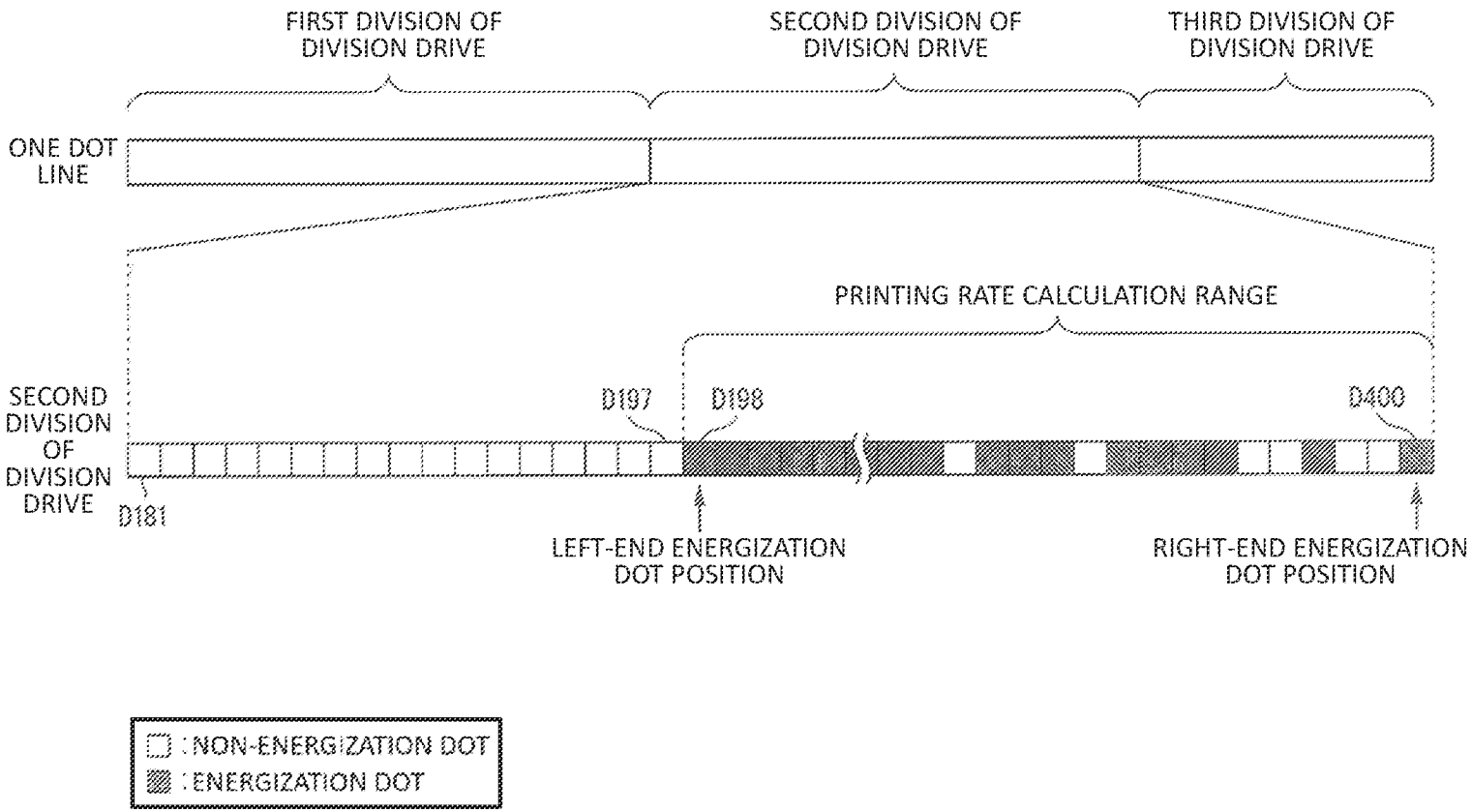
FIG. 11 is a view for illustrating a second division of the division drive in the second embodiment.

FIG. 11 is a view for illustrating a second division of the division drive in the second embodiment. The range from the dot D1 to the dot D180 is the division range 1, and hence the division range 2 is a range from the dot D181. The division range 2 in this example is a range from the dot D181 to the dot D400. In this example, the dots of from the dot D181 to the dot D197 are non-energization dots. Therefore, the dot D198 being the energization dot at the left end of the division range is the left-end energization dot.

When the maximum number of simultaneously energized dots is 100 dots, the division range 2 includes 100 energization dots. In this example, the left-end energization dot is the dot D198, and the right-end energization dot is the dot D400. Accordingly, the printing rate calculation range is a range from the dot D198 to the dot D400. Therefore, the printing rate of the division range 2 is 49.5 percent (%). As described above, the division range 1 and the division range 2 each include 100 energization dots, but the printing rate calculation range is different, and hence the printing rate is also different.

Figure 12:
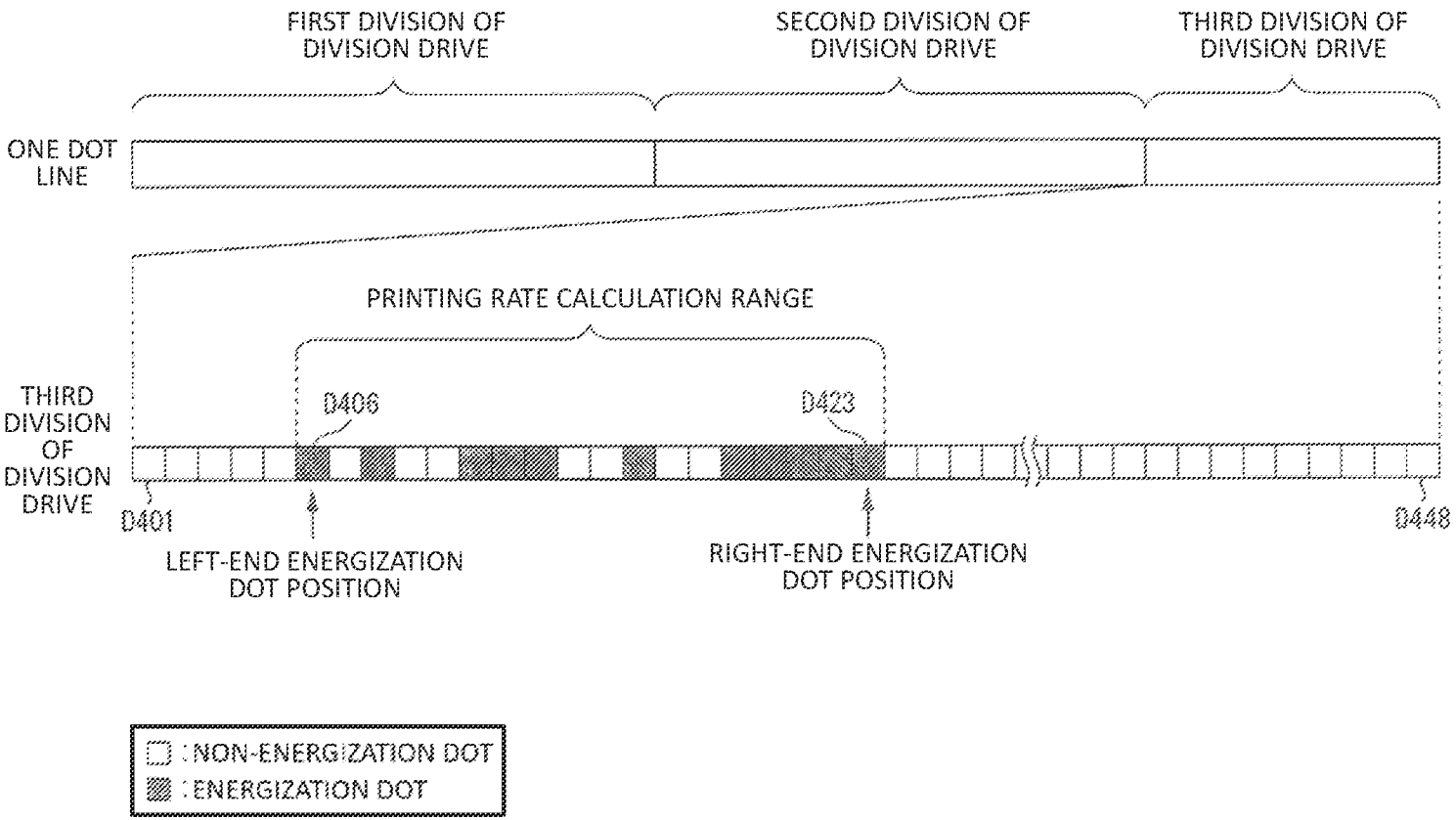
FIG. 12 is a view for illustrating a third division of the division drive in the second embodiment.

FIG. 12 is a view for illustrating a third division of the division drive in the second embodiment. The range from the dot D181 to the dot D400 is the division range 2, and hence the division range 3 is a range from the dot D401. In this example, one dot line is from the dot D1 to the dot D448, and hence the division range 3 is a range from the dot D400 to the dot D448. Therefore, the printing rate calculation range in the division range 3 is a range from the dot D406 to the dot D423. For example, when the division range 3 includes eleven energization dots, the printing rate of the division range 3 is 23.4 percent (%).

Figure 13:
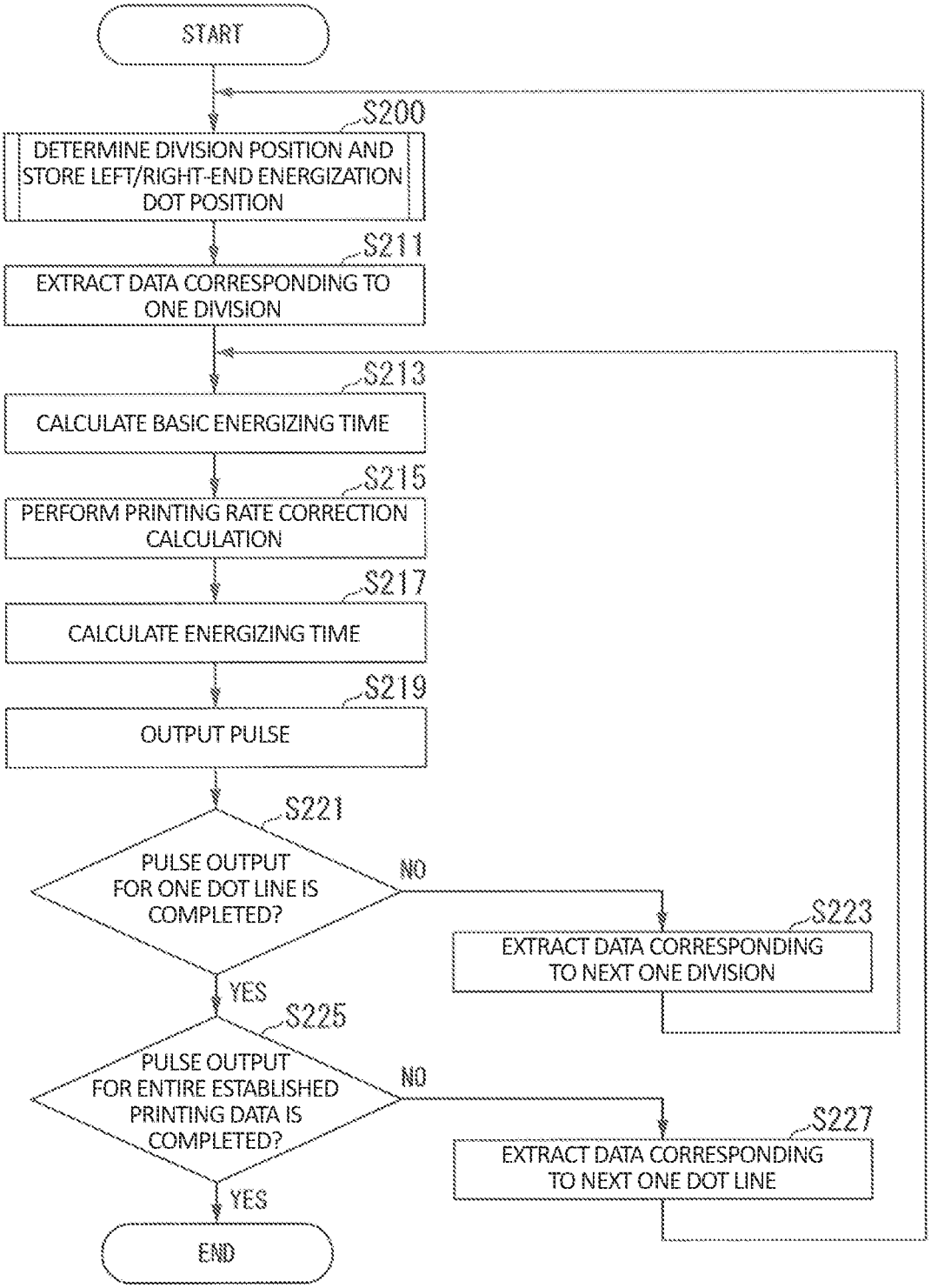
FIG. 13 is a flowchart for illustrating a flow of pulse output processing in the second embodiment.

FIG. 13 is a flowchart for illustrating a flow of pulse output processing in the second embodiment. With reference to FIG. 13, the flow of the pulse output processing is described. The pulse output processing to be described with reference to FIG. 13 is processing to be performed after the processing of data extraction for one dot line described with reference to FIG. 6. The processing of data extraction for one dot line described with reference to FIG. 6 is similar to that in the first embodiment, and hence description thereof is omitted here.

(Step S200) The division drive determination unit 145 determines whether or not to perform the division drive. Specifically, the division drive determination unit 145 determines whether or not each of the dots included in one dot line is an energization dot, and determines the corresponding position as a division position when the number of energization dots included in one dot line matches with a predetermined maximum number of simultaneously energized dots. Further, in this processing, the division drive determination unit 145 determines the left-end energization dot position and the right-end energization dot position. The division drive determination unit 145 determines not to perform the division drive when the number of energization dots included in one dot line does not reach the predetermined maximum number of simultaneously energized dots.

Figure 14:
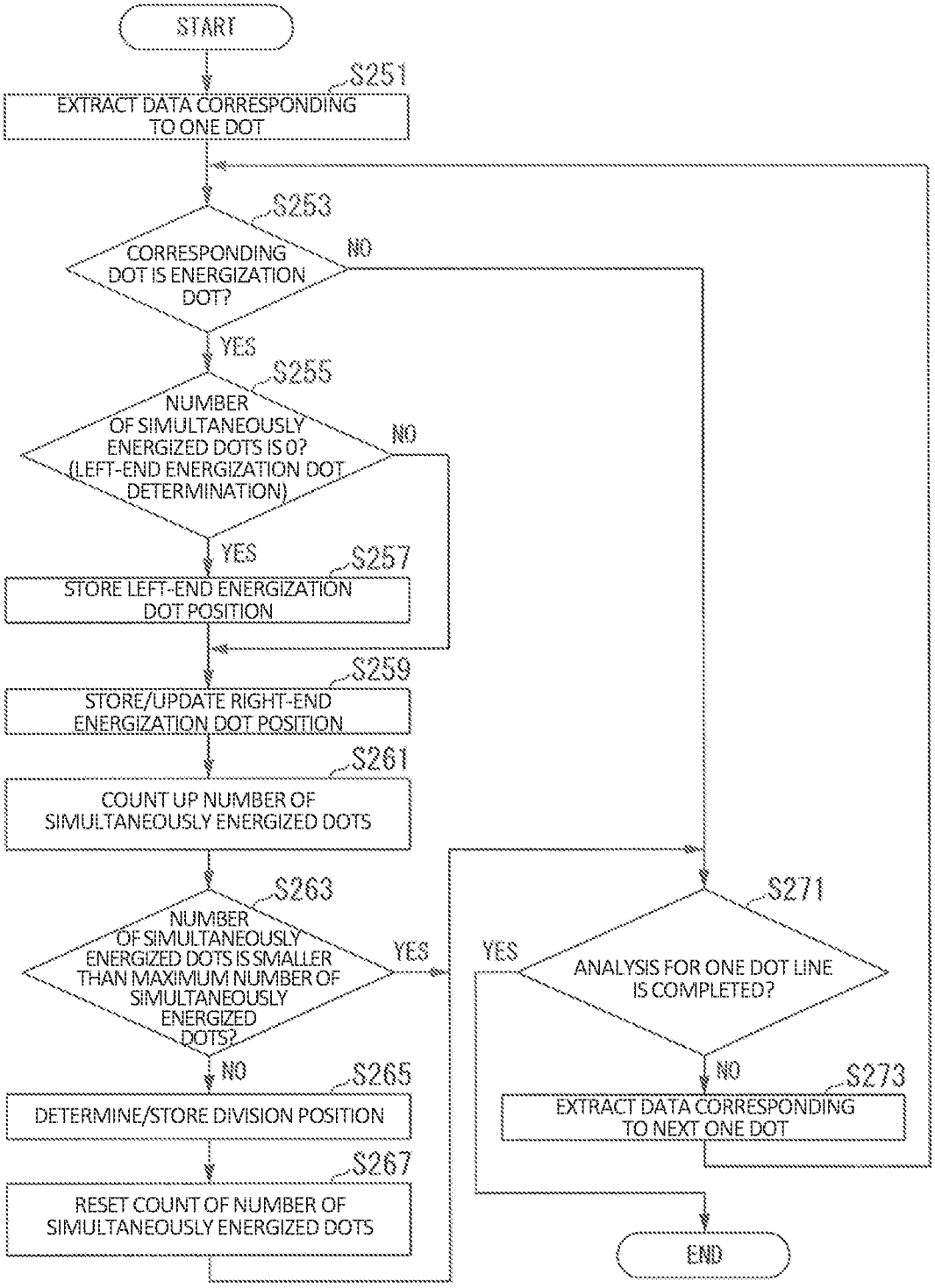
FIG. 14 is a flowchart for illustrating a flow of division position determination processing and printing rate calculation range determination processing in the second embodiment.

FIG. 14 is a flowchart for illustrating a flow of division position determination processing and printing rate calculation range determination processing in the second embodiment. With reference to FIG. 14, the division position determination processing and the printing rate calculation range determination processing are described. The processing to be described with reference to FIG. 14 is a modification example of the printing rate correction calculation processing in the first embodiment, which has been described with reference to FIG. 8.

(Step S251) The printing rate correction value calculation unit 141A extracts data corresponding to one dot from the data corresponding to one dot line. For example, the printing rate correction value calculation unit 141A extracts the left-end dot (dot D1 illustrated in FIG. 10).

(Step S253) The printing rate correction value calculation unit 141A determines whether or not the corresponding dot is an energization dot. When the corresponding dot is an energization dot (Step S253: YES), the printing rate correction value calculation unit 141A advances the processing to Step S255. When the corresponding dot is a non-energization dot (Step S253: NO), the printing rate correction value calculation unit 141A advances the processing to Step S271.

(Step S255) The printing rate correction value calculation unit 141A determines whether or not the corresponding dot being the energization dot is a first energization dot. For example, when a value stored in the left-end energization dot storage unit 142L is reset, the printing rate correction value calculation unit 141A determines that the corresponding dot being the energization dot is the first energization dot. When the corresponding dot is the first energization dot (Step S255: YES), the printing rate correction value calculation unit 141A advances the processing to Step S257. When the corresponding dot is not the first energization dot (Step S255: NO), the printing rate correction value calculation unit 141A advances the processing to Step S259.

(Step S257) The printing rate correction value calculation unit 141A causes the left-end energization dot storage unit 142L to store the position of the corresponding dot being the energization dot.

(Step S259) The printing rate correction value calculation unit 141A causes the right-end energization dot storage unit 142R to store the position of the corresponding dot being the energization dot. When a value is already stored in the right-end energization dot storage unit 142R, the printing rate correction value calculation unit 141A updates the stored value.

(Step S261) The division drive determination unit 145 counts up the number of simultaneously energized dots stored in a simultaneously-energized dot number storage unit (not shown). The number of simultaneously energized dots is a value representing the number of dots to be simultaneously energized in a predetermined range.

(Step S263) The division drive determination unit 145 determines whether or not the number of simultaneously energized dots stored in the simultaneously-energized dot number storage unit is smaller than the predetermined maximum number of simultaneously energized dots. When the number of simultaneously energized dots stored in the simultaneously-energized dot number storage unit is smaller than the predetermined maximum number of simultaneously energized dots (Step S263: YES), the division drive determination unit 145 advances the processing to Step S271. When the number of simultaneously energized dots stored in the simultaneously-energized dot number storage unit is not smaller than the predetermined maximum number of simultaneously energized dots, that is, when the number of simultaneously energized dots stored in the simultaneously-energized dot number storage unit is equal to or larger than the predetermined maximum number of simultaneously energized dots (Step S263: NO), the division drive determination unit 145 advances the processing to Step S265.

(Step S265) The division drive determination unit 145 determines the corresponding dot position as the division position. The division drive determination unit 145 causes a division position storage unit (not shown) to store the division position.

(Step S267) The division drive determination unit 145 resets the simultaneously-energized dot number storage unit.

(Step S271) The energizing pulse calculation unit 140A determines whether or not the analysis for one dot line is completed. When the analysis for one dot line is completed (Step S271: YES), the energizing pulse calculation unit 140A ends the processing. When the analysis for one dot line is not completed (Step S271: NO), the energizing pulse calculation unit 140A advances the processing to Step S273.

(Step S273) The energizing pulse calculation unit 140A extracts data corresponding to the next one dot. For example, the energizing pulse calculation unit 140A extracts data of the adjacent dot.

Referring back to FIG. 13, the energizing pulse calculation unit 140A calculates the energizing time based on the calculated printing rate. With reference back to FIG. 13, the pulse output processing is described.

(Step S211) The printing rate calculation unit 143 extracts data in the division range. Specifically, the printing rate calculation unit 143 specifies the division range based on the information of the division position stored in the division position storage unit, and extracts the data of the division range included in one dot line.

(Step S213) The energizing pulse calculation unit 140A calculates the basic energizing time. The basic energizing time refers to an energizing time independent of the printing rate.

(Step S215) The printing rate correction value calculation unit 141A performs printing rate correction calculation for each dot line. Specifically, the printing rate calculation range determination unit 142A sets the position information of the dots stored in the left-end energization dot storage unit 142L and the right-end energization dot storage unit 142R as the printing rate calculation range, to thereby calculate the printing rate calculation range. The printing rate calculation unit 143 calculates the printing rate correction value based on the calculated printing rate calculation range. The printing rate calculation unit 143 sets the heating elements 42 present in a range of each of the plurality of divided pieces of printing data as the heating elements 42 to be controlled, to thereby calculate the printing rate for each dot line.

(Step S217) The energizing time calculation unit 144 calculates the energizing time for each dot line based on the printing rate correction calculation performed by the printing rate correction value calculation unit 141.

(Step S219) The energizing pulse output unit 150 outputs an energizing pulse corresponding to the energizing time calculated by the energizing time calculation unit 144 to the thermal head 41.

(Step S221) When the pulse output for one dot line is completed (Step S221: YES), the energizing pulse calculation unit 140A advances the processing to Step S225. When pulse output for one dot line is not completed (Step S221: NO), the energizing pulse calculation unit 140A advances the processing to Step S223.

(Step S223) The energizing pulse calculation unit 140A extracts data of the next division range. After the energizing pulse calculation unit 140A extracts the data of the next division range, the energizing pulse calculation unit 140A advances the processing to Step S213.

(Step S225) When the pulse output for all dot lines of the established printing data is completed (Step S225: YES), the energizing pulse calculation unit 140A ends the processing. When the pulse output for all dot lines of the established printing data is not completed (Step S225: NO), the energizing pulse calculation unit 140A advances the processing to Step S227.

(Step S227) The printing data creation unit 130 extracts data corresponding to the next one dot line. The printing data creation unit 130 provides the extracted data corresponding to the next one dot line to the energizing pulse calculation unit 140A, and advances the processing to Step S200.

According to the second embodiment described above, the head control unit 514A further includes the division drive determination unit 145. The head control unit 514A includes the division drive determination unit 145 to perform the division drive when the number of energization dots included in one dot line is equal to or larger than the predetermined maximum number of simultaneously energized dots. In the energizing pulse calculation unit 140A, the printing rate calculation range determination unit 142A determines the printing rate calculation range for each division range, and the energizing time calculation unit 144 calculates the energizing time for each division range. Therefore, according to at least one embodiment of the present invention, the energizing time suitable for the printing data of each division range can be calculated. Further, according to the second embodiment, the energizing time suitable for the printing data can be calculated, and hence the heating element 42 can be supplied with energy suitable for the printing data.

Further, according to at least one embodiment of the present invention, the division drive is performed, and hence the number of dots to be simultaneously energized can be restricted. That is, through restriction of the number of dots to be simultaneously energized, the maximum peak power can be suppressed. Further, according to at least one embodiment of the present invention, through suppression of the maximum peak power, variation in power supply voltage can be suppressed. Further, when the thermal printer 1 is driven by a battery, through suppression of the maximum peak power, a small-capacity battery can be used.

Third Embodiment

Figure 15:
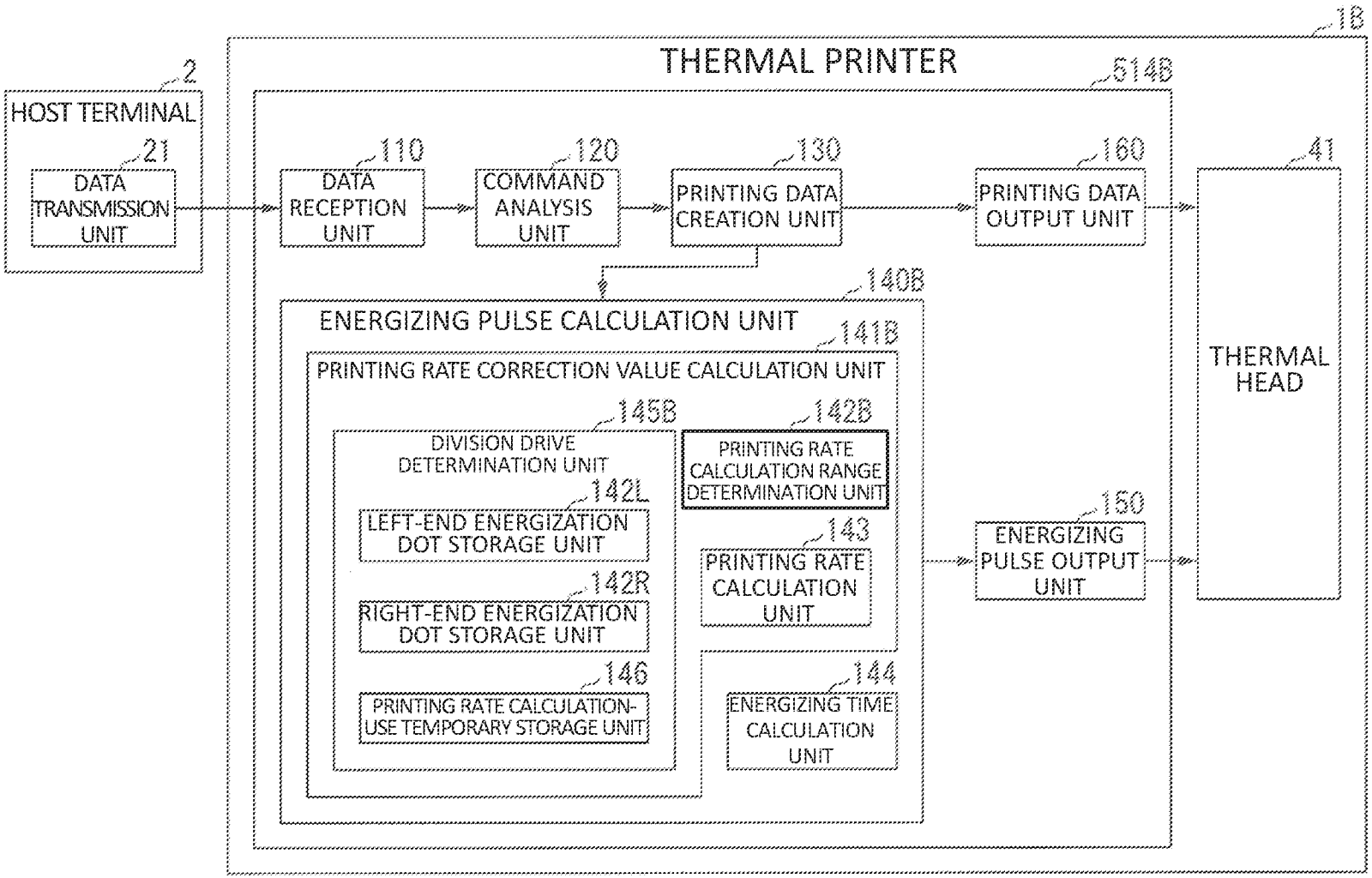
FIG. 15 is a diagram for illustrating an example of a functional configuration of a head control unit in a third embodiment of the present invention.

With reference to FIG. 15 to FIG. 18, an example of a thermal printer 1B according to a third embodiment of the present invention is described. FIG. 15 is a diagram for illustrating an example of a functional configuration of a head control unit 514B in the third embodiment. The head control unit 514B is different from the head control unit 514A in including an energizing pulse calculation unit 140B in place of the energizing pulse calculation unit 140A. Like configurations as those described with reference to FIG. 9 are denoted by like reference symbols, and description thereof may be omitted. The energizing pulse calculation unit 140B includes a printing rate correction value calculation unit 141B and the energizing time calculation unit 144. The printing rate correction value calculation unit 141B is a modification example of the printing rate correction value calculation unit 141A. The printing rate correction value calculation unit 141B includes a division drive determination unit 145B, a printing rate calculation range determination unit 142B, and the printing rate calculation unit 143.

Figure 16A:
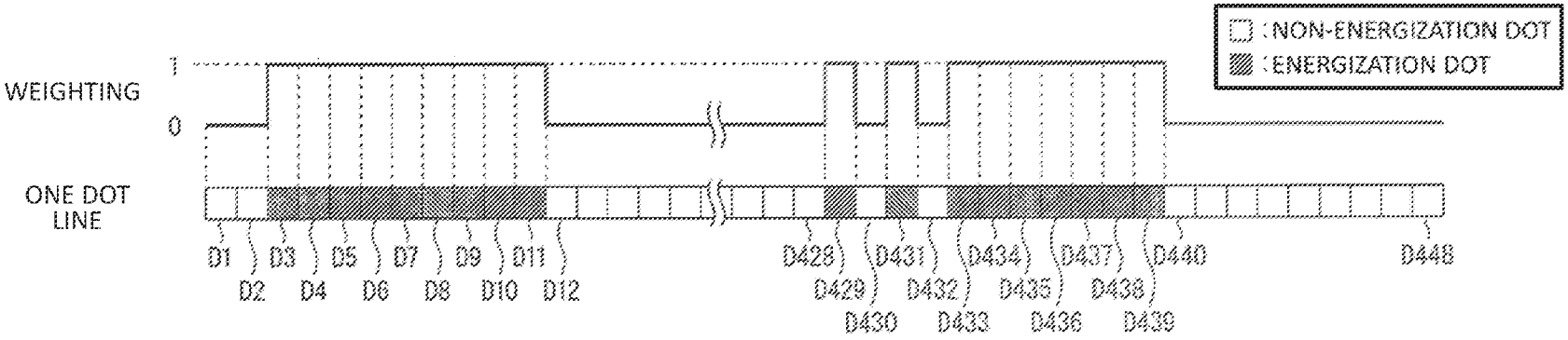
FIG. 16A and FIG. 16B are views for illustrating a printing rate calculating method in the third embodiment.
Figure 16B:
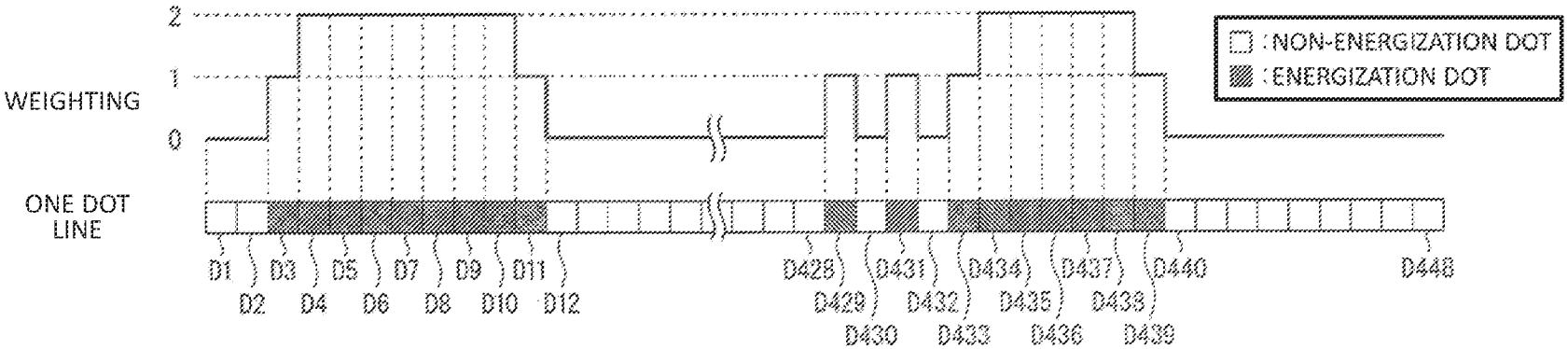

In the third embodiment, the energizing pulse calculation unit 140B is configured to calculate the printing rate by providing different weightings between a case in which adjacent heating elements 42 are continuous energization dots and a case in which the adjacent heating elements 42 are not continuous energization dots. Specifically, the division drive determination unit 145B includes a printing rate calculation-use temporary storage unit 146, to thereby perform weighting based on a pattern of the printing data to calculate the printing rate. For example, in the third embodiment, when continuous energization dots are present, the printing rate correction value calculation unit 141B counts the continuous energization dots as one or more dots (for example, 2 dots). The printing rate calculation-use temporary storage unit 146 is a temporary storage unit configured to store the number of simultaneously energized dots to be used when the printing rate is calculated. With reference to FIG. 16A and FIG. 16B, a weighting method in the third embodiment is described.

FIG. 16A and FIG. 16B are views for illustrating a printing rate calculating method in the third embodiment. With reference to FIG. 16A and FIG. 16B, an example of the weighting method is described. For example, when the thermal head 41 includes 448 dots of heating elements 42, one dot line includes 448 dots of from the dot D1 to the dot D448. In this example, description is given of an example of a case in which, in the data corresponding to one dot line, only dots from the dot D3 to the dot D11, the dot D429, the dot D431, and dots from the dot D433 to the dot D439 are energization dots.

FIG. 16A is a view for illustrating an example of a case in which weighting is not performed. FIG. 16A shows data corresponding to one dot line and weighting corresponding to each piece of data. In the example illustrated in FIG. 16A, the weighting is not performed, and hence the weighting of all of the energization dots is 1. When the weighting is not performed, the printing rate correction value calculation unit 141B calculates each of all energization dots as one dot.

FIG. 16B is a view for illustrating an example of a case in which weighting is performed. FIG. 16B shows data corresponding to one dot line and weighting corresponding to each piece of data. In the example illustrated in FIG. 16B, the weighting is 2 when the dots at both ends are energization dots, and the weighting is 1 when any one of the dots at both ends is a non-energization dot.

For example, of the dot D2 and the dot D4 being the dots at both ends of the dot D3, the dot D2 is a non-energization dot, and hence the weighting of the dot D3 is 1. Meanwhile, both of the dot D3 and the dot D5 being the dots at both ends of the dot D4 are energization dots, and hence the weighting of the dot D4 is 2.

When the energization dot having the weighting of 1 is counted as one dot and the energization dot having the weighting of 2 is counted as 2 dots, in the example of FIG. 16B, although there are 18 energization dots, the number of energization dots calculated in consideration of the weighting is 30 dots. In this example, the energization dot having the weighting of 2 is calculated as 2 dots, but the present invention is not limited to this example. The amount of weight to be provided to the energization dot having the weighting of 2 can be freely set. For example, the energization dot having the weighting of 2 can be calculated as 1.2 dots or 3 dots.

Figure 17A:
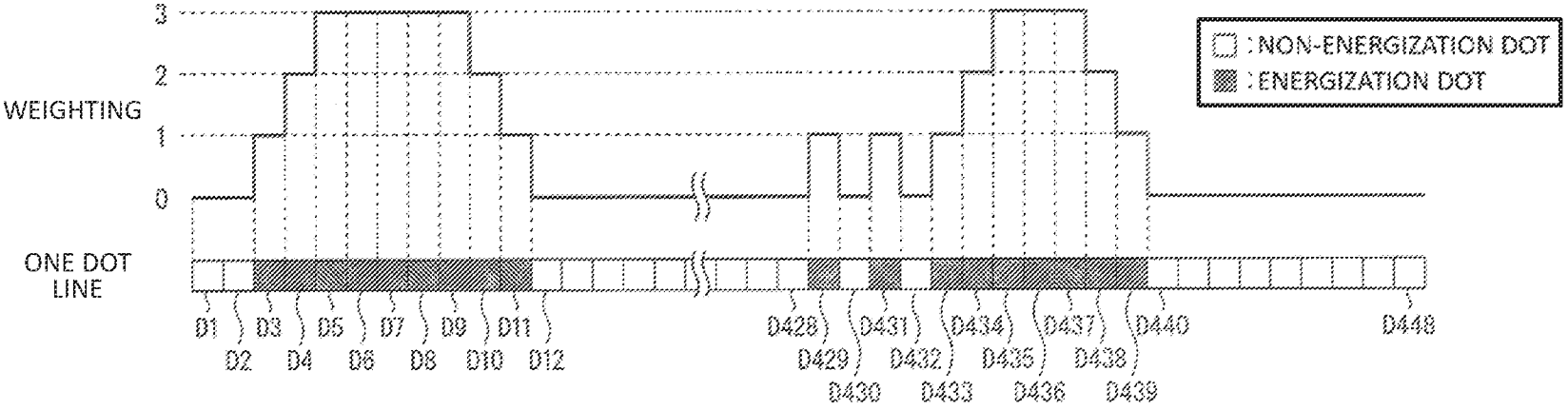
FIG. 17A and FIG. 17B are views for illustrating a modification example of the printing rate calculating method in the third embodiment.
Figure 17B:
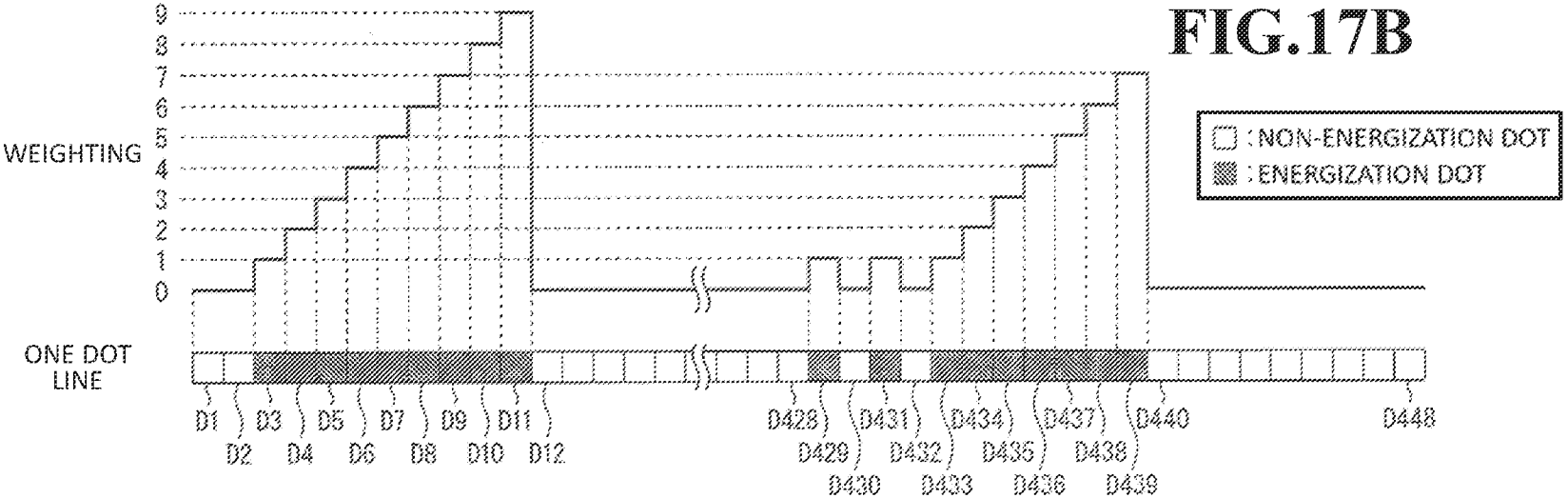

FIG. 17A and FIG. 17B are views for illustrating a modification example of the printing rate calculating method in the third embodiment. Modification examples of the weighting method described with reference to FIG. 16A and FIG. 16B are described with reference to FIG. 17A and FIG. 17B. Similarly to the case described with reference to FIG. 16A and FIG. 16B, description is given of an example of a case in which, in the data corresponding to one dot line, only dots from the dot D3 to the dot D11, the dot D429, the dot D431, and dots from the dot D433 to the dot D439 are energization dots.

FIG. 17A is an example of a case in which weighting is performed based on whether or not respective pairs of dots at both ends are energization dots. In this example, when all of the four dots corresponding to the respective pairs of dots at both ends are energization dots, the weighting is set to 3. Even when all of the four dots corresponding to the respective pairs of dots at both ends are not energization dots, in a case in which both of the dots at both ends are energization dots, the weighting is set to 2. When any one of the dots at both ends is a non-energization dot, the weighting is set to 1.

For example, of the dot D2 and the dot D4 at both ends of the dot D3, the dot D2 is a non-energization dot, and hence the weighting of the dot D3 is 1. Both of the dot D3 and the dot D5 at both ends of the dot D4 are energization dots, but of the dot D2, the dot D3, the dot D5, and the dot D6 corresponding to the respective pairs of dots at both ends of the dot D4, the dot D2 is a non-energization dot, and hence the weighting of the dot D4 is 2. All of the dot D3, the dot D4, the dot D6, and the dot D7 corresponding to the respective pairs of dots at both ends of the dot D5 are energization dots, and hence the weighting of the dot D5 is 3.

FIG. 17B is an example of a case in which the weight is linearly increased depending on the number of continuous energization dots. In this example, the weighting is performed by the number of energization dots continuously provided in order from the left end. That is, in this example, the weighting is determined based on the number of continuous energization dots on the left of a corresponding dot. For example, the dot D2 positioned on the left of the dot D3 is a non-energization dot, and hence the weighting is 1. On the left of the dot D4, one energization dot is present, and hence the weighting is 2. On the left of the dot D5, two energization dots are present, and hence the weighting is 3. In the example illustrated in FIG. 17B, as described above, the weighting is gradually increased by the number of continuous energization dots.

Figure 18:
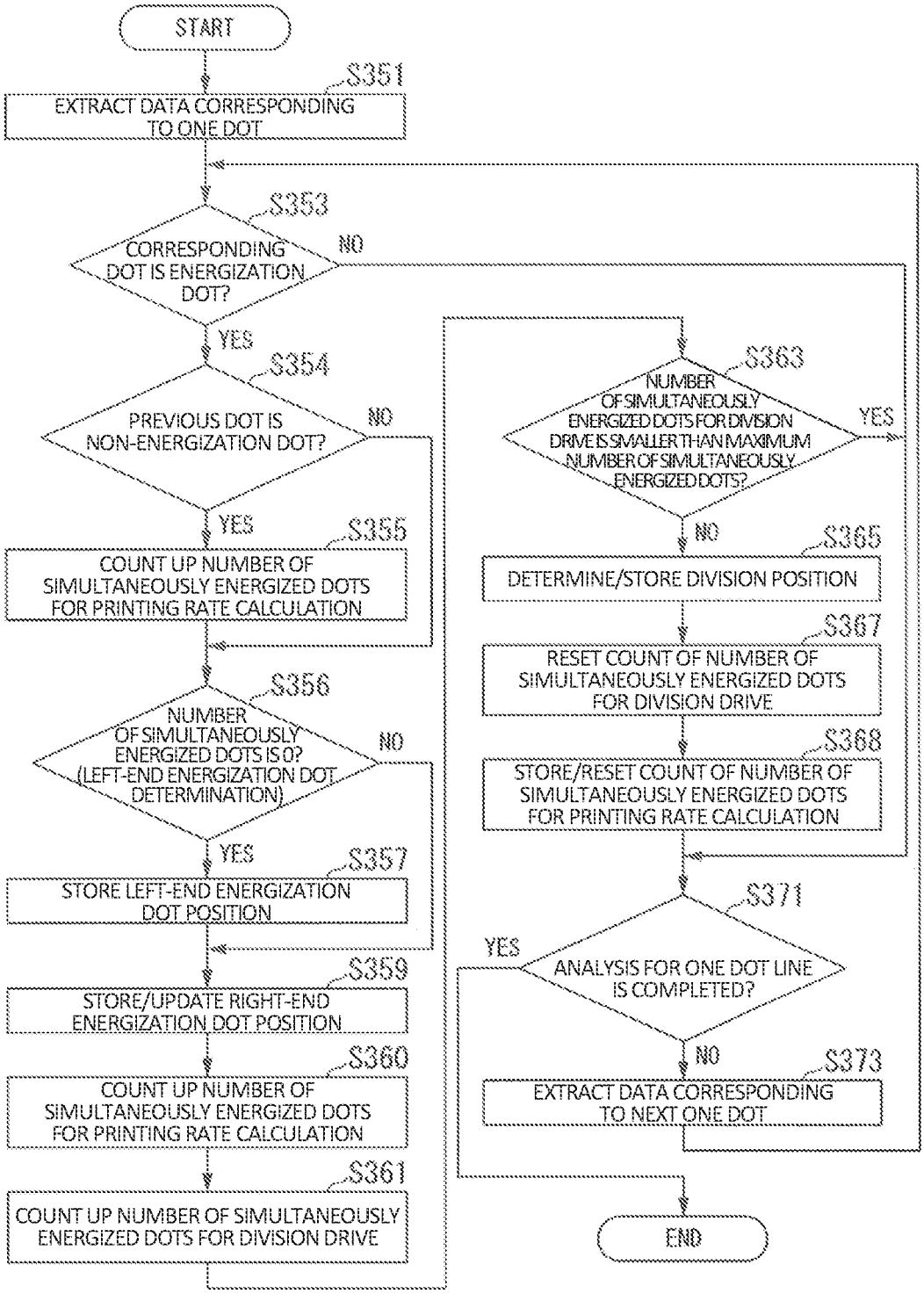
FIG. 18 is a flowchart for illustrating a flow of division position determination processing and printing rate calculation range determination processing in the third embodiment.

FIG. 18 is a flowchart for illustrating a flow of division position determination processing and printing rate calculation range determination processing in the third embodiment. In the third embodiment, Step S200 described with reference to FIG. 13 is different from that in the second embodiment. With reference to FIG. 18, description is given of the flow of the division position determination processing and the printing rate calculation range determination processing in the third embodiment as a process in place of Step S200. The processing to be described with reference to FIG. 18 is a modification example of the division position determination processing and the printing rate calculation range determination processing in the second embodiment, which have been described with reference to FIG. 14.

(Step S351) The printing rate correction value calculation unit 141B extracts data corresponding to one dot from the data corresponding to one dot line. For example, the printing rate correction value calculation unit 141B extracts the left-end dot.

(Step S353) The printing rate correction value calculation unit 141B determines whether or not the corresponding dot is an energization dot. When the corresponding dot is an energization dot (Step S353: YES), the printing rate correction value calculation unit 141B advances the processing to Step S354. When the corresponding dot is a non-energization dot (Step S353: NO), the printing rate correction value calculation unit 141B advances the processing to Step S371.

(Step S354) The division drive determination unit 145B determines whether or not the previous dot is a non-energization dot. Specifically, the division drive determination unit 145B determines that the previous dot is an energization dot when a value is stored in the printing rate calculation-use temporary storage unit 146, and determines that the previous dot is a non-energization dot when the printing rate calculation-use temporary storage unit 146 is reset. When the previous dot is a non-energization dot (Step S354: YES), the division drive determination unit 145B advances the processing to Step S355. When the previous dot is an energization dot (Step S354: NO), the division drive determination unit 145B advances the processing to Step S356.

(Step S355) The division drive determination unit 145B counts up the value of the printing rate calculation-use temporary storage unit 146.

(Step S356) The printing rate correction value calculation unit 141B determines whether or not the corresponding dot being the energization dot is the first energization dot. For example, when a value stored in the left-end energization dot storage unit 142L is reset, the printing rate correction value calculation unit 141B determines that the corresponding dot being the energization dot is the first energization dot. When the corresponding dot is the first energization dot (Step S356. YES), the printing rate correction value calculation unit 141B advances the processing to Step S357. When the corresponding dot is not the first energization dot (Step S356: NO), the printing rate correction value calculation unit 141B advances the processing to Step S359.

(Step S357) The printing rate correction value calculation unit 141B causes the left-end energization dot storage unit 142L to store the position of the corresponding dot being the energization dot.

(Step S359) The printing rate correction value calculation unit 141B causes the right-end energization dot storage unit 142R to store the position of the corresponding dot being the energization dot. When a value is already stored in the right-end energization dot storage unit 142R, the printing rate correction value calculation unit 141B updates the stored value.

(Step S360) The division drive determination unit 145B counts up the value of the printing rate calculation-use temporary storage unit 146.

(Step S361) The division drive determination unit 145B counts up the number of simultaneously energized dots stored in the simultaneously-energized dot number storage unit (not shown). The number of simultaneously energized dots is a value representing the number of dots to be simultaneously energized in a predetermined range.

(Step S363) The division drive determination unit 145B determines whether or not the number of simultaneously energized dots stored in the simultaneously-energized dot number storage unit is smaller than the predetermined maximum number of simultaneously energized dots. When the number of simultaneously energized dots stored in the simultaneously-energized dot number storage unit is smaller than the predetermined maximum number of simultaneously energized dots (Step S363: YES), the division drive determination unit 145B advances the processing to Step S371. When the number of simultaneously energized dots stored in the simultaneously-energized dot number storage unit is not smaller than the predetermined maximum number of simultaneously energized dots, that is, when the number of simultaneously energized dots stored in the simultaneously-energized dot number storage unit is equal to or larger than the predetermined maximum number of simultaneously energized dots (Step S363: NO), the division drive determination unit 145B advances the processing to Step S365.

(Step S365) The division drive determination unit 145B determines the corresponding dot position as the division position. The division drive determination unit 145B causes the division position storage unit (not shown) to store the division position.

(Step S367) The division drive determination unit 145B resets the simultaneously-energized dot number storage unit.

(Step S368) The division drive determination unit 145B resets the printing rate calculation-use temporary storage unit 146.

(Step S371) The energizing pulse calculation unit 140B determines whether or not the analysis for one dot line is completed. When the analysis for one dot line is completed (Step S371: YES), the energizing pulse calculation unit 140B ends the processing. When the analysis for one dot line is not completed (Step S371: NO), the energizing pulse calculation unit 140B advances the processing to Step S373.

(Step S373) The energizing pulse calculation unit 140B extracts data corresponding to the next one dot. For example, the energizing pulse calculation unit 140B extracts data of the adjacent dot. After that, the processing advances to Step S353.

According to the third embodiment described above, the head control unit 514B includes the printing rate calculation-use temporary storage unit 146 to count up the number of continuous dots, to thereby calculate the printing rate with the continuous dots being weighted. Therefore, according to the third embodiment, a further appropriate energizing time can be calculated. Further, according to the third embodiment, the continuous dots are weighted, and hence the head control unit 514B can calculate the energizing time in consideration of the effect of heat from the adjacent heating element 42.

Fourth Embodiment

Figure 19:
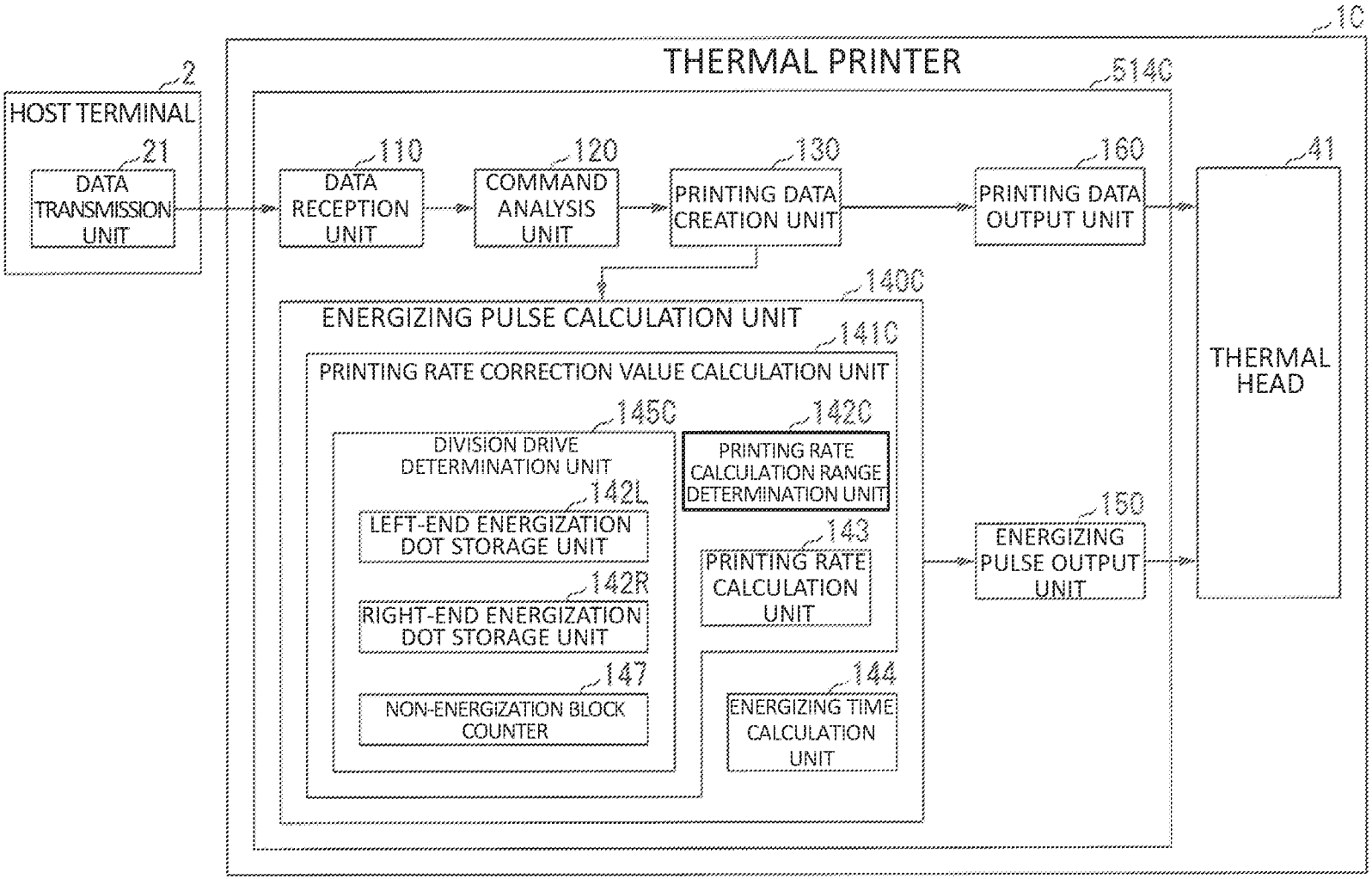
FIG. 19 is a diagram for illustrating an example of a functional configuration of a head control unit in a fourth embodiment of the present invention.
Figure 20A:
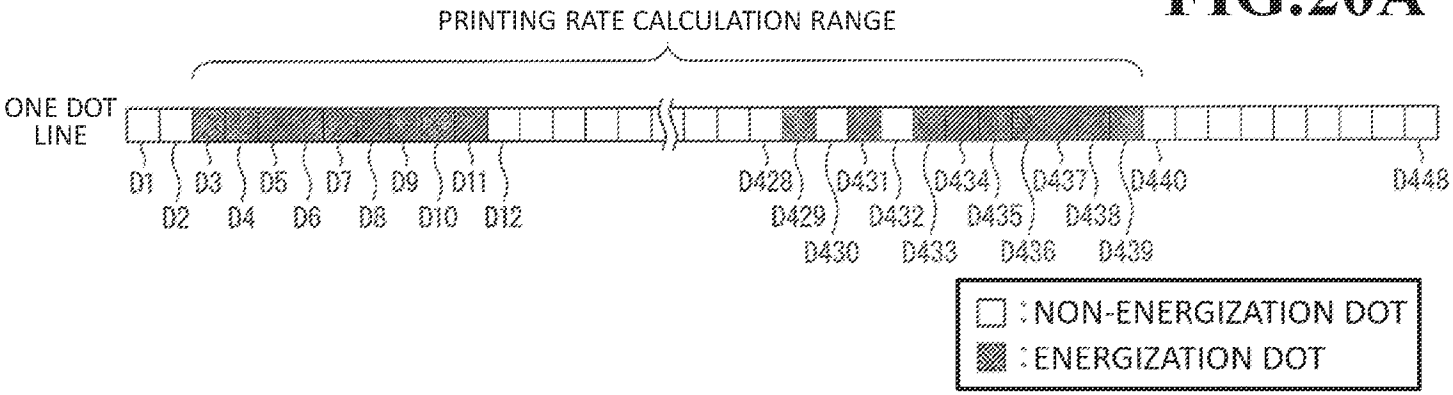
FIG. 20A and FIG. 20B are views for illustrating a printing rate calculating method in the fourth embodiment.
Figure 20B:
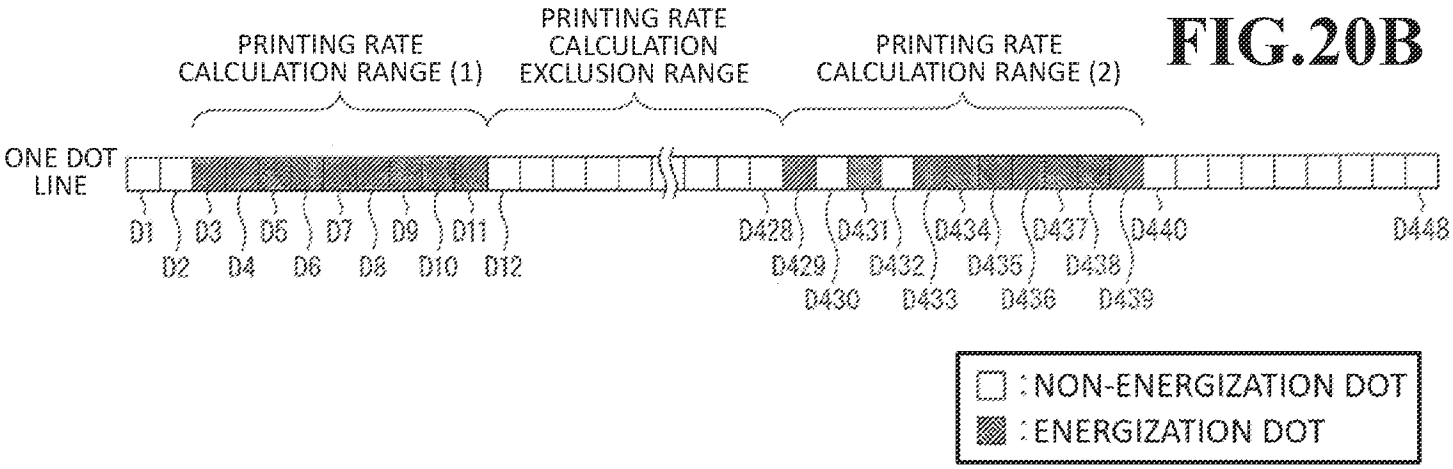
Figure 21:
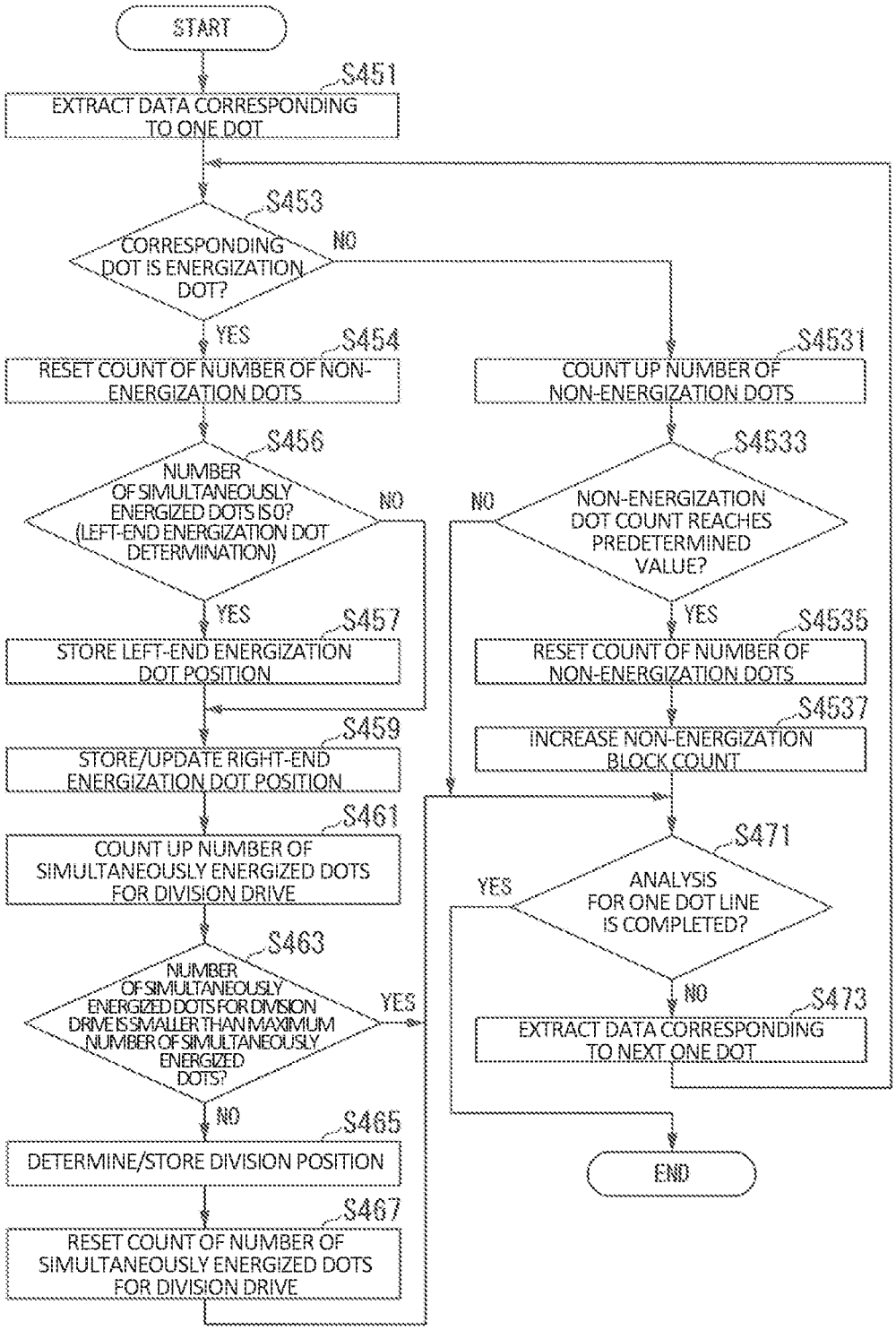
FIG. 21 is a flowchart for illustrating a flow of division position determination processing and printing rate calculation range determination processing in the fourth embodiment.

With reference to FIG. 19 to FIG. 21, an example of a thermal printer 1C according to a fourth embodiment of the present invention is described. FIG. 19 is a diagram for illustrating an example of a functional configuration of a head control unit 514C in the fourth embodiment. The head control unit 514C is different from the head control unit 514B in including an energizing pulse calculation unit 140C in place of the energizing pulse calculation unit 140B. Like configurations as those described with reference to FIG. 15 are denoted by like reference symbols, and description thereof may be omitted. The energizing pulse calculation unit 140C includes a printing rate correction value calculation unit 141C and the energizing time calculation unit 144. The printing rate correction value calculation unit 141C is a modification example of the printing rate correction value calculation unit 141B. The printing rate correction value calculation unit 141C includes a division drive determination unit 145C, a printing rate calculation range determination unit 142C, and the printing rate calculation unit 143.

In the fourth embodiment, the division drive determination unit 145C includes a non-energization block counter 147 to count the number of non-energization dots included in the printing data. When a range including a predetermined number of continuous non-energization dots or more is present, the range is excluded from the printing rate calculation range. The non-energization block counter 147 is a counter configured to count the number of non-energization blocks. Specifically, the division drive determination unit 145C is configured to store the number of non-energization dots (for example, 8 dots) to be counted as non-energization blocks in a storage unit (not shown), and cause the non-energization block counter 147 to store the number of non-energization blocks included in the pattern of the printing data. The printing rate calculation range determination unit 142C is configured to decrease the number of dots corresponding to the number of non-energization blocks from the printing rate calculation range, to thereby determine the printing rate calculation range. With reference to FIG. 20A and FIG. 20B, a method of determining the printing rate calculation range in the fourth embodiment is described.

FIG. 20A and FIG. 20B are views for illustrating a printing rate calculating method in the fourth embodiment. With reference to FIG. 20A and FIG. 20B, an example of a method of excluding the non-energization blocks is described. For example, when the thermal head 41 includes 448 dots of heating elements 42, one dot line includes 448 dots of from the dot D1 to the dot D448. In this example, description is given of an example of a case in which, in the data corresponding to one dot line, only dots from the dot D3 to the dot D11, the dot D429, the dot D431, and dots from the dot D433 to the dot D439 are energization dots.

FIG. 20A is a view for illustrating an example of a case in which the non-energization blocks are not excluded. FIG. 20A shows data corresponding to one dot line. In the example illustrated in FIG. 20A, a range from the dot D3 being the left-end energization dot to the dot D439 being the right-end energization dot is the printing rate calculation range. When the non-energization blocks are not excluded, the printing rate calculation range determination unit 142C determines the range from the dot D3 to the dot D439 as the printing rate calculation range.

FIG. 20B is a view for illustrating an example of a case in which the non-energization blocks are excluded. FIG. 20B shows data corresponding to one dot line. In an example illustrated in FIG. 20B, dots from the dot D12 to the dot D428 are non-energization dots. When the non-energization blocks are excluded, the printing rate calculation range determination unit 142C determines a range obtained by excluding the range from the dot D12 to the dot D428 from the range from the dot D3 to the dot D439 as the printing rate calculation range. That is, when a range including a predetermined number of continuous non-energization dots or more is present, the printing rate calculation range determination unit 142C excludes the range from the printing rate calculation range.

FIG. 21 is a flowchart for illustrating a flow of division position determination processing and printing rate calculation range determination processing in the fourth embodiment. In the fourth embodiment, Step S200 described with reference to FIG. 13 is different from that in the second embodiment. With reference to FIG. 21, description is given of the flow of the division position determination processing and the printing rate calculation range determination processing in the fourth embodiment as a process in place of Step S200. The processing to be described with reference to FIG. 21 is a modification example of the division position determination processing and the printing rate calculation range determination processing in the second embodiment, which have been described with reference to FIG. 14.

(Step S451) The printing rate correction value calculation unit 141C extracts data corresponding to one dot from the data corresponding to one dot line. For example, the printing rate correction value calculation unit 141C extracts the left-end dot.

(Step S453) The printing rate correction value calculation unit 141C determines whether or not the corresponding dot is an energization dot. When the corresponding dot is an energization dot (Step S453: YES), the printing rate correction value calculation unit 141C advances the processing to Step S454. When the corresponding dot is a non-energization dot (Step S453: NO), the printing rate correction value calculation unit 141C advances the processing to Step S4531.

(Step S454) The division drive determination unit 145C resets a non-energization dot counter (not shown).

(Step S4531) The division drive determination unit 145C counts up the non-energization dot counter.

(Step S4533) The division drive determination unit 145C determines whether or not the value stored in the non-energization dot counter has reached the number of non-energization dots to be counted as non-energization blocks. For example, when the non-energization blocks are 8 dots, the division drive determination unit 145C determines whether or not the value stored in the non-energization dot counter has reached 8. When the value stored in the non-energization dot counter is smaller than 8 (Step S4533: NO), the division drive determination unit 145C advances the processing to Step S471. When the value stored in the non-energization dot counter is 8 (Step S4533: YES), the division drive determination unit 145C advances the processing to Step S4535.

(Step S4535) The division drive determination unit 145C resets the non-energization dot counter.

(Step S4537) The division drive determination unit 145C counts up the non-energization block counter 147, and advances the processing to Step S471.

(Step S456) The printing rate correction value calculation unit 141C determines whether or not the corresponding dot being the energization dot is a first energization dot. For example, when a value stored in the left-end energization dot storage unit 142L is reset, the printing rate correction value calculation unit 141C determines that the corresponding dot being the energization dot is the first energization dot. When the corresponding dot is the first energization dot (Step S456: YES), the printing rate correction value calculation unit 141C advances the processing to Step S457. When the corresponding dot is not the first energization dot (Step S456: NO), the printing rate correction value calculation unit 141C advances the processing to Step S459.

(Step S457) The printing rate correction value calculation unit 141C causes the left-end energization dot storage unit 142L to store the position of the corresponding dot being the energization dot.

(Step S459) The printing rate correction value calculation unit 141C causes the right-end energization dot storage unit 142R to store the position of the corresponding dot being the energization dot. When a value is already stored in the right-end energization dot storage unit 142R, the printing rate correction value calculation unit 141C updates the stored value.

(Step S461) The division drive determination unit 145C counts up the number of simultaneously energized dots stored in the simultaneously-energized dot number storage unit (not shown). The number of simultaneously energized dots is a value representing the number of dots to be simultaneously energized in a predetermined range.

(Step S463) The division drive determination unit 145C determines whether or not the number of simultaneously energized dots stored in the simultaneously-energized dot number storage unit is smaller than the predetermined maximum number of simultaneously energized dots. When the number of simultaneously energized dots stored in the simultaneously-energized dot number storage unit is smaller than the predetermined maximum number of simultaneously energized dots (Step S463: YES), the division drive determination unit 145C advances the processing to Step S471. When the number of simultaneously energized dots stored in the simultaneously-energized dot number storage unit is not smaller than the predetermined maximum number of simultaneously energized dots, that is, when the number of simultaneously energized dots stored in the simultaneously-energized dot number storage unit is equal to or larger than the predetermined maximum number of simultaneously energized dots (Step S463: NO), the division drive determination unit 145C advances the processing to Step S465.

(Step S465) The division drive determination unit 145C determines the corresponding dot position as the division position. The division drive determination unit 145C causes the division position storage unit (not shown) to store the division position.

(Step S467) The division drive determination unit 145C resets the simultaneously-energized dot number storage unit.

(Step S471) The energizing pulse calculation unit 140C determines whether or not the analysis for one dot line is completed. When the analysis for one dot line is completed (Step S471: YES), the energizing pulse calculation unit 140C ends the processing. When the analysis for one dot line is not completed (Step S471: NO), the energizing pulse calculation unit 140C advances the processing to Step S473.

(Step S473) The energizing pulse calculation unit 140C extracts data corresponding to the next one dot. For example, the energizing pulse calculation unit 140C extracts data of the adjacent dot. The energizing pulse calculation unit 140C advances the processing to Step S453.

According to the fourth embodiment described above, the head control unit 514C includes the non-energization block counter 147 to count the number of non-energization dots. When a range including a predetermined number of continuous non-energization dots or more is present, the head control unit 514C calculates the printing rate with the range being excluded from the printing rate calculation range. Therefore, according to the fourth embodiment, only the range having the printing can be extracted to calculate the printing rate. Thus, according to the fourth embodiment, a further appropriate energizing time can be calculated.

Fifth Embodiment

Figure 22:
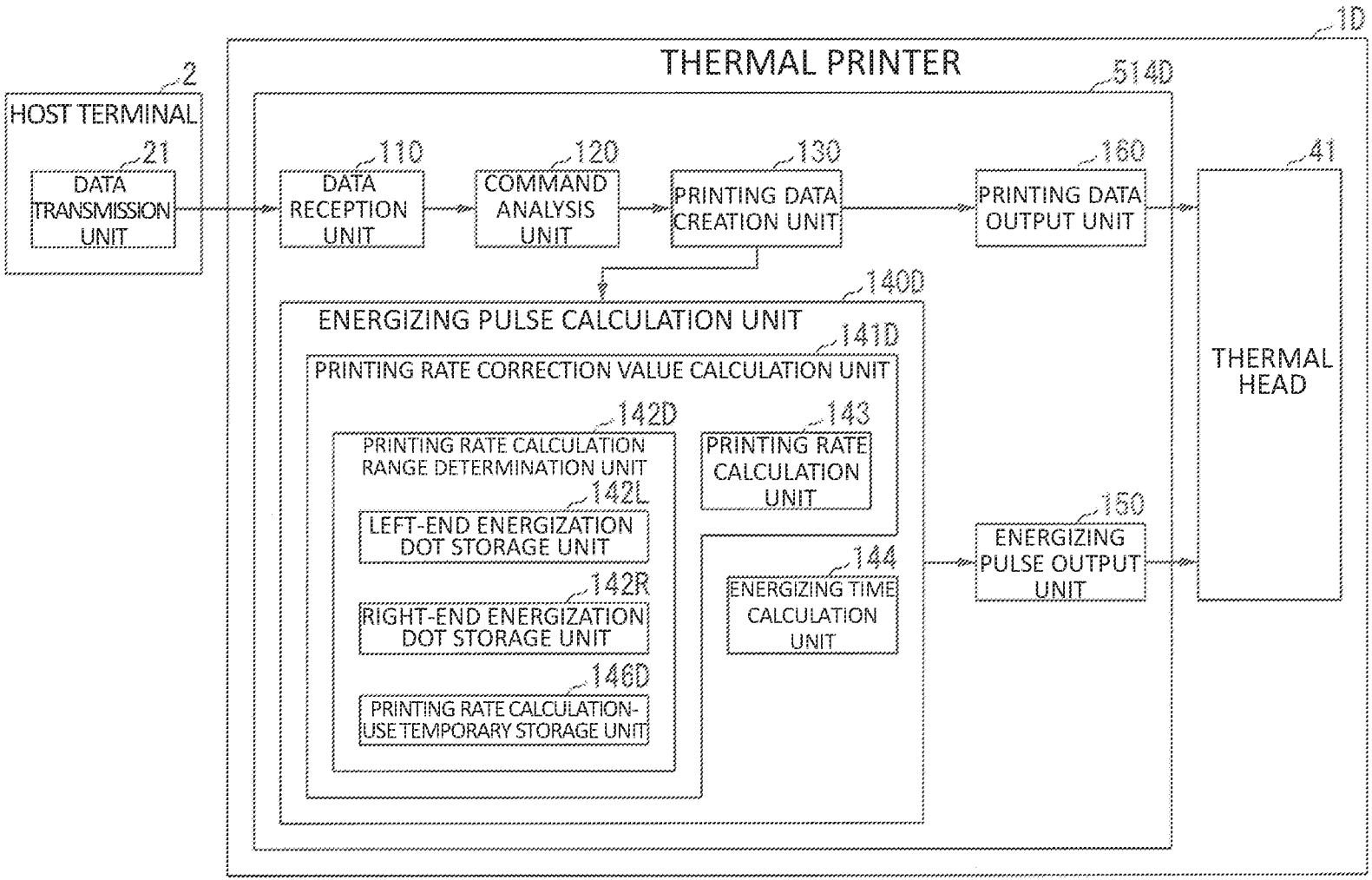
FIG. 22 is a diagram for illustrating an example of a functional configuration of a head control unit in a fifth embodiment of the present invention.
Figure 23:
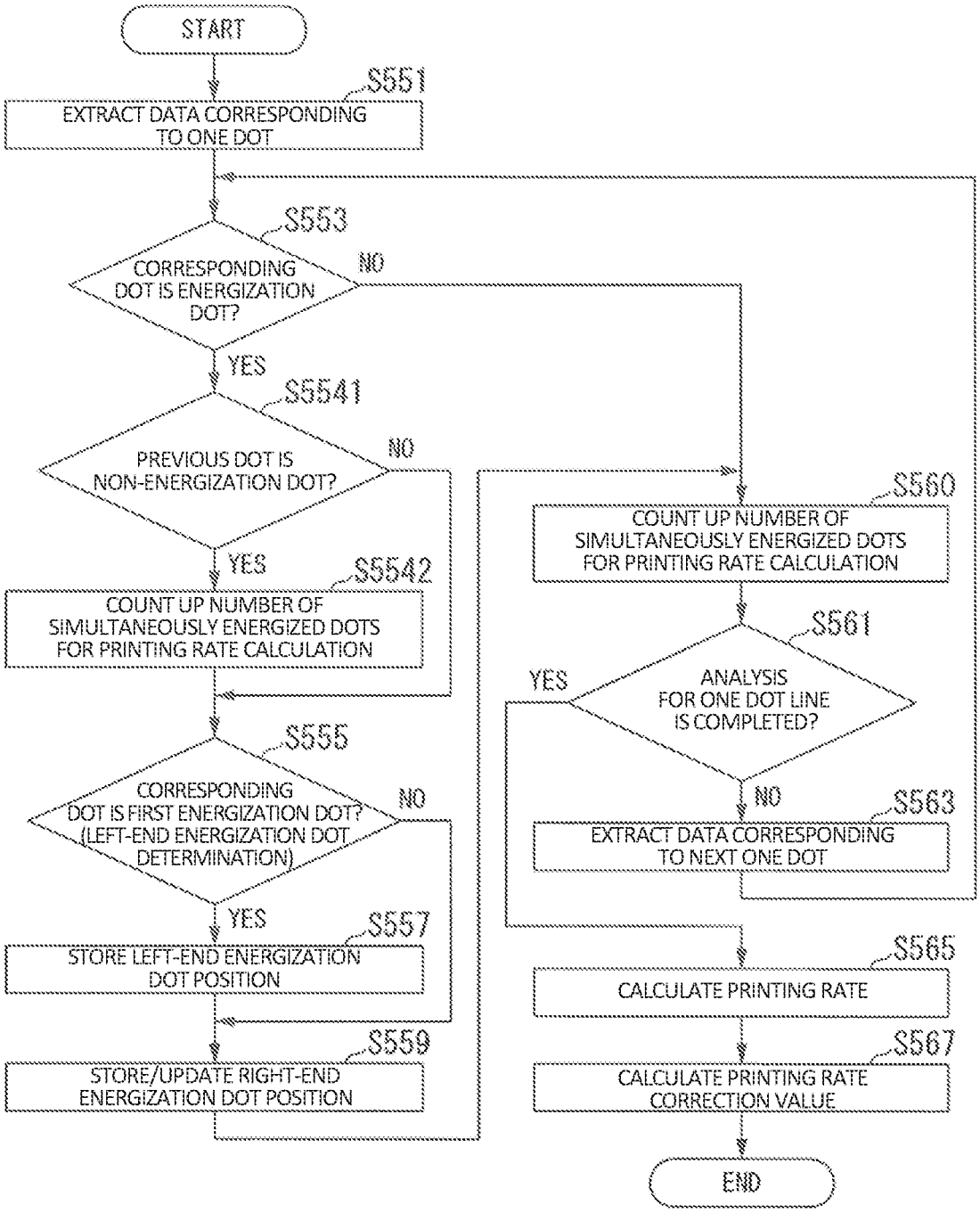
FIG. 23 is a flowchart for illustrating a flow of printing rate correction calculation processing in the fifth embodiment.

With reference to FIG. 22 and FIG. 23, an example of a thermal printer 1D according to a fifth embodiment of the present invention is described. In the fifth embodiment, the weighting control described in the third embodiment is applied to the configuration described in the first embodiment. That is, in the third embodiment, the weighting control is performed with the division drive being performed, but in the fifth embodiment, the weighting control is applied without performing the division drive.

FIG. 22 is a diagram for illustrating an example of a functional configuration of a head control unit 514D in the fifth embodiment. The head control unit 514D is different from the head control unit 514A in including an energizing pulse calculation unit 140D in place of the energizing pulse calculation unit 140A. Like configurations as those described with reference to FIG. 4 are denoted by like reference symbols, and description thereof may be omitted. The energizing pulse calculation unit 140D includes a printing rate correction value calculation unit 141D and the energizing time calculation unit 144. The printing rate correction value calculation unit 141D is a modification example of the printing rate correction value calculation unit 141A. The printing rate correction value calculation unit 141D includes a printing rate calculation range determination unit 142D and the printing rate calculation unit 143.

In the fifth embodiment, the printing rate calculation range determination unit 142D includes a printing rate calculation-use temporary storage unit 146D to perform weighting based on the pattern of the printing data, to thereby calculate the printing rate. The weighting control is as that described above with reference to FIG. 16A to FIG. 17B.

FIG. 23 is a flowchart for illustrating a flow of printing rate correction calculation processing in the fifth embodiment. With reference to FIG. 23, the flow of the printing rate correction calculation processing in the fifth embodiment is described.

(Step S551) The printing rate correction value calculation unit 141D extracts data corresponding to one dot from the data corresponding to one dot line. For example, the printing rate correction value calculation unit 141D extracts the left-end dot.

(Step S553) The printing rate correction value calculation unit 141D determines whether or not the corresponding dot is an energization dot. When the corresponding dot is an energization dot (Step S553: YES), the printing rate correction value calculation unit 141D advances the processing to Step S5541. When the corresponding dot is a non-energization dot (Step S553: NO), the printing rate correction value calculation unit 141D advances the processing to Step S560.

(Step S5541) The printing rate calculation range determination unit 142D determines whether or not the previous dot is a non-energization dot. Specifically, when a value is stored in the printing rate calculation-use temporary storage unit 146D, the printing rate calculation range determination unit 142D determines that the previous dot is an energization dot, and when the printing rate calculation-use temporary storage unit 146D is reset, the printing rate calculation range determination unit 142D determines that the previous dot is a non-energization dot. When the previous dot is a non-energization dot (Step S5541: YES), the printing rate calculation range determination unit 142D advances the processing to Step S5542. When the previous dot is an energization dot (Step S5541: NO), the printing rate calculation range determination unit 142D advances the processing to Step S555.

(Step S5542) The printing rate calculation range determination unit 142D counts up the value of the printing rate calculation-use temporary storage unit 146D.

(Step S555) The printing rate correction value calculation unit 141D determines whether or not the corresponding dot being the energization dot is a first energization dot. For example, when a value stored in the left-end energization dot storage unit 142L is reset, the printing rate correction value calculation unit 141D determines that the corresponding dot being the energization dot is the first energization dot. When the corresponding dot is the first energization dot (Step S555: YES), the printing rate correction value calculation unit 141D advances the processing to Step S557. When the corresponding dot is not the first energization dot (Step S555: NO), the printing rate correction value calculation unit 141D advances the processing to Step S559.

(Step S557) The printing rate correction value calculation unit 141D causes the left-end energization dot storage unit 142L to store the position of the corresponding dot being the energization dot.

(Step S559) The printing rate correction value calculation unit 141D causes the right-end energization dot storage unit 142R to store the position of the corresponding dot being the energization dot. When a value is already stored in the right-end energization dot storage unit 142R, the printing rate correction value calculation unit 141D updates the stored value.

(Step S560) The printing rate calculation range determination unit 142D counts up the value of the printing rate calculation-use temporary storage unit 146D.

(Step S561) The energizing pulse calculation unit 140D determines whether or not the analysis for one dot line is completed. When the analysis for one dot line is completed (Step S561: YES), the energizing pulse calculation unit 140D advances the processing to Step S565. When the analysis for one dot line is not completed (Step S561: NO), the energizing pulse calculation unit 140D advances the processing to Step S563.

(Step S563) The energizing pulse calculation unit 140D extracts data corresponding to the next one dot. For example, the energizing pulse calculation unit 140D extracts data of the adjacent dot. The energizing pulse calculation unit 140D advances the processing to Step S553.

(Step S565) The printing rate calculation range determination unit 142D sets the position information of the dots stored in the left-end energization dot storage unit 142L and the right-end energization dot storage unit 142R as the printing rate calculation range, to thereby calculate the printing rate calculation range.

(Step S567) The printing rate calculation range determination unit 142D calculates a printing rate correction value based on the calculated printing rate calculation range.

According to the fifth embodiment described above, the head control unit 514D performs the weighting control even when the division drive is not performed. The head control unit 514D includes the printing rate calculation-use temporary storage unit 146D to count up the number of continuous dots, to thereby calculate the printing rate with the continuous dots being weighted. Therefore, according to the fifth embodiment, even when the division drive is not performed, an appropriate energizing time can be calculated.

Sixth Embodiment

Figure 24:
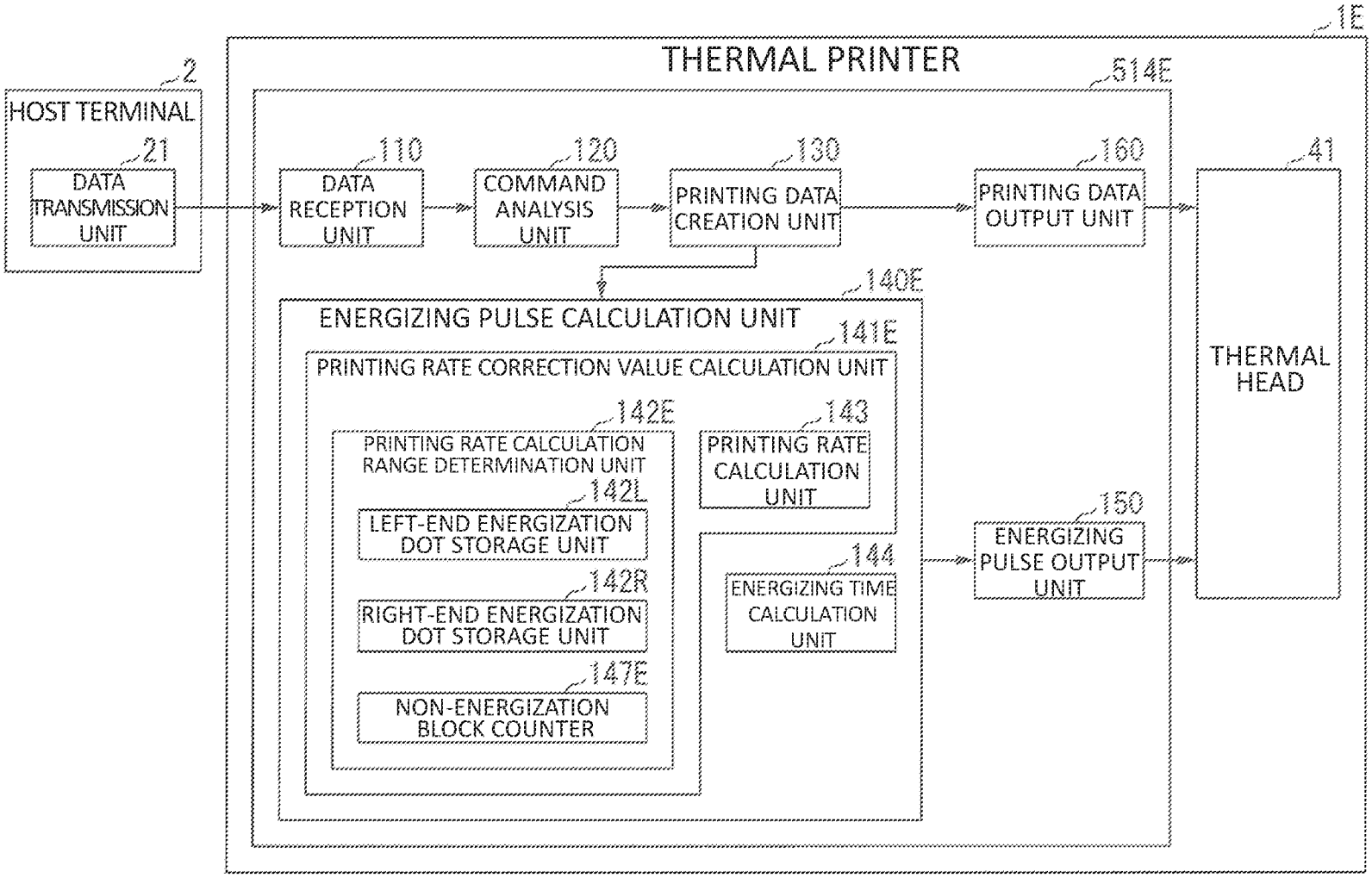
FIG. 24 is a diagram for illustrating an example of a functional configuration of a head control unit in a sixth embodiment of the present invention.
Figure 25:
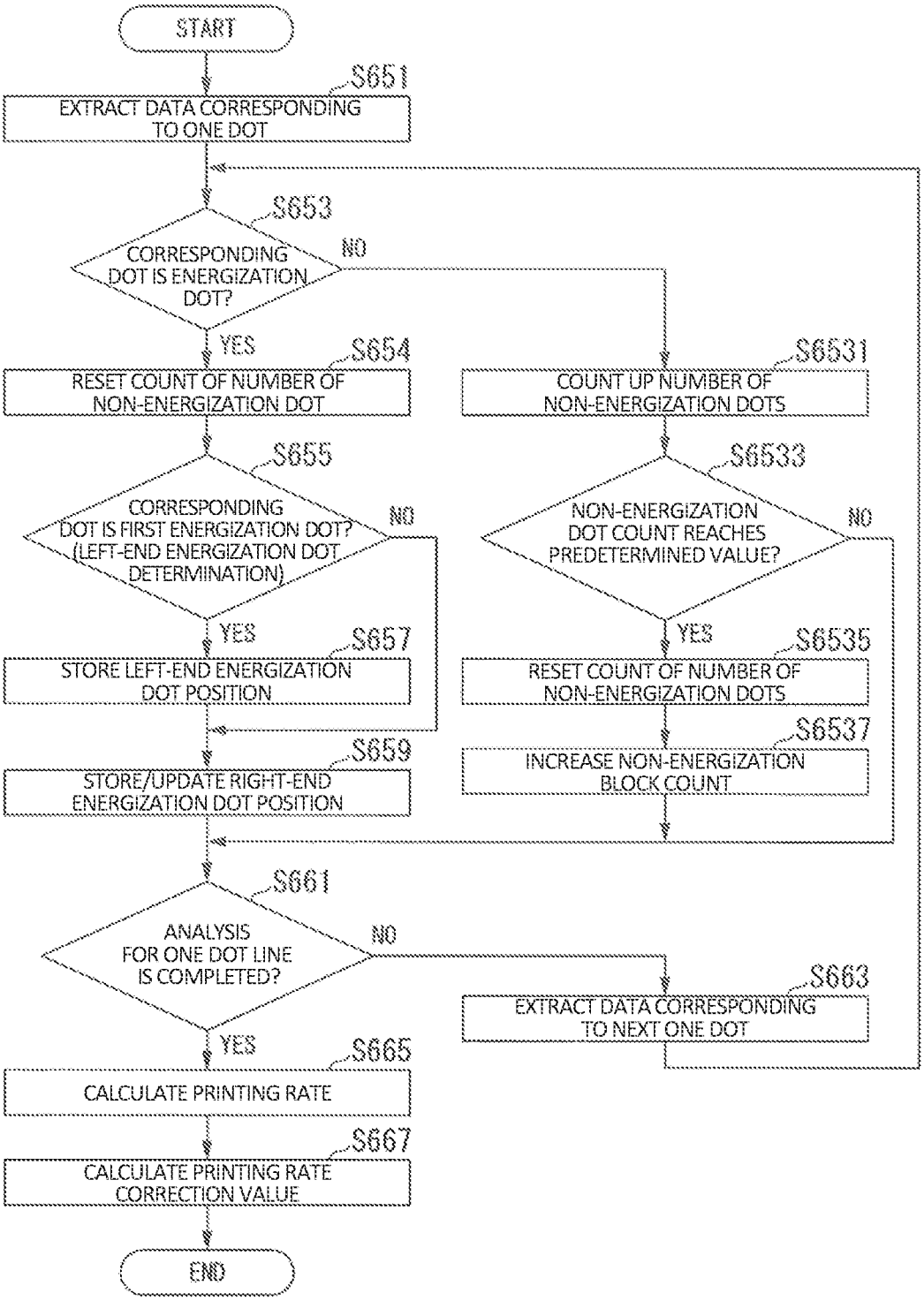
FIG. 25 is a flowchart for illustrating a flow of printing rate correction calculation processing in the sixth embodiment.

With reference to FIG. 24 and FIG. 25, an example of a thermal printer 1E according to a sixth embodiment of the present invention is described. In the sixth embodiment, the non-energization block counting control described in the fourth embodiment is applied to the configuration described in the first embodiment. That is, in the fourth embodiment, the non-energization block counting control is performed with the division drive being performed, but in the sixth embodiment, the non-energization block counting control is applied without performing the division drive.

FIG. 24 is a diagram for illustrating an example of a functional configuration of a head control unit 514E in the sixth embodiment. The head control unit 514E is different from the head control unit 514A in including an energizing pulse calculation unit 140E in place of the energizing pulse calculation unit 140A. Like configurations as those described with reference to FIG. 4 are denoted by like reference symbols, and description thereof may be omitted. The energizing pulse calculation unit 140E includes a printing rate correction value calculation unit 141E and the energizing time calculation unit 144. The printing rate correction value calculation unit 141E is a modification example of the printing rate correction value calculation unit 141A. The printing rate correction value calculation unit 141E includes a printing rate calculation range determination unit 142E and the printing rate calculation unit 143.

In the sixth embodiment, the printing rate calculation range determination unit 142E includes a non-energization block counter 147E to count the number of non-energization dots included in the printing data. When a range including a predetermined number of continuous non-energization dots or more is present, the range is excluded from the printing rate calculation range. The method of calculating the printing rate with the non-energization dots being excluded from the printing rate calculation range is the same as that described with reference to FIG. 20A and FIG. 20B.

FIG. 25 is a flowchart for illustrating a flow of printing rate correction calculation processing in the sixth embodiment. With reference to FIG. 25, the flow of the printing rate correction calculation processing in the sixth embodiment is described.

(Step S651) The printing rate correction value calculation unit 141E extracts data corresponding to one dot from the data corresponding to one dot line. For example, the printing rate correction value calculation unit 141E extracts the left-end dot.

(Step S653) The printing rate correction value calculation unit 141E determines whether or not the corresponding dot is an energization dot. When the corresponding dot is an energization dot (Step S653: YES), the printing rate correction value calculation unit 141E advances the processing to Step S654. When the corresponding dot is a non-energization dot (Step S653: NO), the printing rate correction value calculation unit 141E advances the processing to Step S6531.

(Step S654) The division drive determination unit 145E resets the non-energization dot counter (not shown).

(Step S6531) The division drive determination unit 145E counts up the non-energization dot counter.

(Step S6533) The division drive determination unit 145E determines whether or not the value stored in the non-energization dot counter has reached the number of non-energization dots to be counted as non-energization blocks. For example, when the non-energization blocks are 8 dots, the division drive determination unit 145E determines whether or not the value stored in the non-energization dot counter has reached 8. When the value stored in the non-energization dot counter is smaller than 8 (Step S6533: NO), the division drive determination unit 145E advances the processing to Step S661. When the value stored in the non-energization dot counter is 8 (Step S6533: YES), the division drive determination unit 145E advances the processing to Step S6535.

(Step S6535) The division drive determination unit 145E resets the non-energization dot counter.

(Step S6537) The division drive determination unit 145E counts up the non-energization block counter 147E, and advances the processing to Step S661.

(Step S655) The printing rate correction value calculation unit 141E determines whether or not the corresponding dot being the energization dot is a first energization dot. For example, when a value stored in the left-end energization dot storage unit 142L is reset, the printing rate correction value calculation unit 141E determines that the corresponding dot being the energization dot is the first energization dot. When the corresponding dot is the first energization dot (Step S655: YES), the printing rate correction value calculation unit 141E advances the processing to Step S657. When the corresponding dot is not the first energization dot (Step S655: NO), the printing rate correction value calculation unit 141E advances the processing to Step S659.

(Step S657) The printing rate correction value calculation unit 141E causes the left-end energization dot storage unit 142L to store the position of the corresponding dot being the energization dot.

(Step S659) The printing rate correction value calculation unit 141E causes the right-end energization dot storage unit 142R to store the position of the corresponding dot being the energization dot. When a value is already stored in the right-end energization dot storage unit 142R, the printing rate correction value calculation unit 141E updates the stored value.

(Step S661) The energizing pulse calculation unit 140E determines whether or not the analysis for one dot line is completed. When the analysis for one dot line is completed (Step S661: YES), the energizing pulse calculation unit 140E advances the processing to Step S665. When the analysis for one dot line is not completed (Step S661: NO), the energizing pulse calculation unit 140E advances the processing to Step S663.

(Step S663) The energizing pulse calculation unit 140E extracts data corresponding to the next one dot. For example, the energizing pulse calculation unit 140E extracts data of the adjacent dot. The energizing pulse calculation unit 140E advances the processing to Step S653.

(Step S665) The printing rate calculation range determination unit 142E sets the position information of the dots stored in the left-end energization dot storage unit 142L and the right-end energization dot storage unit 142R as the printing rate calculation range, to thereby calculate the printing rate calculation range.

(Step S667) The printing rate calculation range determination unit 142E calculates a printing rate correction value based on the calculated printing rate calculation range.

According to the sixth embodiment described above, the head control unit 514E performs the non-energization block counting control even when the division drive is not performed. The head control unit 514E includes the non-energization block counter 147E to count the number of non-energization dots. When a range including a predetermined number of continuous non-energization dots or more is present, the head control unit 514E calculates the printing rate with the range being excluded from the printing rate calculation range. Therefore, according to the sixth embodiment, only the range having the printing can be extracted to calculate the printing rate. Thus, according to the sixth embodiment, an appropriate energizing time can be calculated even when the division drive is not performed.

All or a part of the functions of the thermal printer 1 described above may be recorded as a program on a computer-readable recording medium, and this program may be executed by a computer system. The computer system includes an OS and a peripheral device and other such hardware. Examples of the computer-readable recording medium include a flexible disk, a magneto-optical disk, a read only memory (ROM), a CD-ROM, and other such portable medium, a hard disk drive built into the computer system and other such storage device, and a volatile memory (random access memory (RAM)) provided by a server on the Internet or other such network. The volatile memory is an example of a recording medium configured to hold a program for a fixed period of time.

In addition, the above-mentioned program may be transmitted to another computer system through a transmission medium, for example, the Internet or other such network or a telephone line or other such communication line.

The above-mentioned program may also be a program for implementing all or a part of the above-mentioned functions. The program for implementing a part of the above-mentioned functions may be a so-called differential program capable of implementing the above-mentioned functions in combination with a program recorded in advance in the computer system.

While the embodiments of the present invention have been described above with reference to the drawings, specific configurations are not limited to those in the above-mentioned embodiments, and design changes and the like within a scope that does not depart from the gist of the present invention are also included in the present invention.

What is claimed is:

1. A thermal head control device, comprising:

a printing rate calculation range determination unit configured to determine, as a printing rate calculation range, a range from a left-end energization dot to a right-end energization dot among energization dots present in printing data corresponding to heating elements to be controlled among a plurality of heating elements included in a thermal head;

a printing rate calculation unit configured to calculate a printing rate of the printing rate calculation range determined by the printing rate calculation range determination unit;

an energizing time calculation unit configured to calculate an energizing time for which a current is caused to flow through the heating elements based on the printing rate calculated by the printing rate calculation unit; and an output unit configured to output a control signal for driving the heating elements to be controlled of the thermal head, based on the calculated energizing time.

2. The thermal head control device according to claim 1, wherein the energizing time in a case in which the printing rate calculated by the printing rate calculation unit is high is shorter than the energizing time in a case in which the printing rate calculated by the printing rate calculation unit is low.

3. The thermal head control device according to claim 1, wherein the printing rate calculation range determination unit is configured to set, as the heating elements to be controlled, the heating elements corresponding to one row and being included in the thermal head, to thereby determine the printing rate calculation range.

4. The thermal head control device according to claim 1, further comprising a division drive determination unit configured to determine whether to perform division drive of dividing the printing data into a plurality of pieces of printing data for energization when the printing data includes a predetermined number of energization dots or more, wherein the printing rate calculation unit is configured to set, when the division drive determination unit determines to perform the division drive, the heating elements present in a range of each of the plurality of divided pieces of printing data as the heating elements to be controlled, to thereby calculate the printing rate.

5. The thermal head control device according to claim 1, wherein the printing rate calculation unit is configured to calculate the printing rate by providing different weightings between a case in which adjacent heating elements are continuous energization dots and a case in which the adjacent heating elements are not continuous energization dots.

6. The thermal head control device according to claim 1, wherein the printing rate calculation range determination unit is configured to exclude, when a range including a predetermined number of continuous non-energization dots or more is present, the range from the printing rate calculation range.

7. A thermal printer, comprising:

a conveyance mechanism configured to convey a printing medium;

a thermal head configured to perform printing on the printing medium; and the thermal head control device of claim 1, which is configured to control the thermal head.

8. A thermal head control method, comprising:

calculating a printing rate of a predetermined printing rate calculation range in printing data to be transmitted to a thermal head including a plurality of heating elements arranged adjacent to each other;

determining, as the predetermined printing rate calculation range, a range from a left-end energization dot to a right-end energization dot among energization dots present in the printing data;

calculating an energizing time for which a current is caused to flow through the heating elements based on the printing rate calculated in the calculating a printing rate; and outputting a control signal for driving the thermal head based on the calculated energizing time.

* * * * *